US009733000B2

(12) United States Patent
Kawano et al.

(10) Patent No.: US 9,733,000 B2
(45) Date of Patent: Aug. 15, 2017

(54) REFRIGERATION APPARATUS

(71) Applicant: DAIKIN INDUSTRIES, LTD., Osaka-shi, Osaka (JP)

(72) Inventors: Satoshi Kawano, Oostende (BE); Junya Minami, Sakai (JP); Mari Susaki, Sakai (JP); Masahiro Oka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/027,218

(22) PCT Filed: Oct. 2, 2014

(86) PCT No.: PCT/JP2014/076457

§ 371 (c)(1),
(2) Date: Apr. 4, 2016

(87) PCT Pub. No.: WO2015/053168

PCT Pub. Date: Apr. 16, 2015

(65) Prior Publication Data

US 2016/0245568 A1 Aug. 25, 2016

(30) Foreign Application Priority Data

Oct. 7, 2013 (JP) ..... 2013-210147
May 28, 2014 (JP) ..... 2014-110069

(51) Int. Cl.
*F25B 43/00* (2006.01)
*F25B 49/00* (2006.01)
(Continued)

(52) U.S. Cl.
CPC ..... *F25B 49/02* (2013.01); *F25B 13/00* (2013.01); *F25B 40/00* (2013.01); *F25B 43/00* (2013.01);
(Continued)

(58) Field of Classification Search
CPC ..... F25B 2313/0316; F25B 2313/008; F25B 43/00; F25B 2600/2523; F25B 2400/16; F25B 43/006
See application file for complete search history.

(56) References Cited

U.S. PATENT DOCUMENTS 4,019,337 A * 4/1977 Zearfoss, Jr. ..... F25B 1/00 62/113
4,478,050 A * 10/1984 DiCarlo ..... F04B 39/16 62/193
(Continued)

FOREIGN PATENT DOCUMENTS

EP 2 511 630 A1 10/2012
JP 6-201234 A 7/1994
(Continued)

OTHER PUBLICATIONS

International Preliminary Report of corresponding PCT Application No. PCT/JP2014/076457 dated Apr. 21, 2016.
(Continued)

*Primary Examiner* — Ljiljana Ciric
*Assistant Examiner* — Alexis Cox
(74) *Attorney, Agent, or Firm* — Global IP Counselors, LLP

(57) ABSTRACT

A refrigeration apparatus includes a compressor, a heat source-side heat exchanger, a receiver, a utilization-side heat exchange, a receiver degassing pipe interconnecting an upper portion of the receiver and a suction side of the compressor, and a receiver liquid level detection pipe connected to the receiver. The receiver liquid level detection pipe detects whether or not liquid level in the receiver has reached a predetermined position on a lower side of a position where the receiver degassing pipe is connected. The receiver liquid level detection pipe merges with the receiver degassing pipe via a capillary tube. The receiver degassing
(Continued)

pipe has a refrigerant heater to heat refrigerant flowing through the receiver degassing pipe. Whether or not the liquid level in the receiver has reached the predetermined position is detected using a temperature of refrigerant flowing though the receiver degassing pipe.

5 Claims, 8 Drawing Sheets

(51) Int. Cl.
*F25B 49/02* (2006.01)
*F25B 13/00* (2006.01)
*F25B 40/00* (2006.01)

(52) U.S. Cl.
CPC . *F25B 2313/007* (2013.01); *F25B 2313/0233* (2013.01); *F25B 2313/0316* (2013.01); *F25B 2400/13* (2013.01); *F25B 2400/16* (2013.01); *F25B 2700/04* (2013.01)

(56) References Cited

U.S. PATENT DOCUMENTS 9,151,522 B2 * 10/2015 Choi ..... F25B 13/00
2010/0251761 A1 * 10/2010 Yoshimi ..... F25B 1/10 62/524
2012/0291462 A1 * 11/2012 Verma ..... F25B 40/00 62/115
2014/0047855 A1 * 2/2014 Kolarich ..... F25B 49/02 62/129

FOREIGN PATENT DOCUMENTS

JP 11-118266 A 4/1999
JP 2000320916 A * 11/2000
JP 2001-99512 A 4/2001
JP 2005-282885 A 10/2005
JP 2005-308393 A 11/2005
JP 2006-292212 A 10/2006
JP 2007-139244 A 6/2007
JP 2009-210151 A 9/2009
JP 2010-175190 A 8/2010
WO 2011/070954 A1 6/2011

OTHER PUBLICATIONS

International Search Report of corresponding PCT Application No. PCT/JP2014/076457 dated Dec. 22, 2014.
European Search Report of corresponding EP Application No. 14 85 2269.1 dated May 18, 2017.

* cited by examiner

REFRIGERATION APPARATUS

CROSS-REFERENCE TO RELATED APPLICATIONS

This U.S. National stage application claims priority under 35 U.S.C. §119(a) to Japanese Patent Application Nos. 2013-210147, filed in Japan on Oct. 7, 2013, and 2014-110069, filed in Japan on May 28, 2014, the entire contents of which are hereby incorporated herein by reference.

TECHNICAL FIELD

The present invention relates to a refrigeration apparatus, and particularly a refrigeration apparatus that includes a compressor, a heat source-side heat exchanger, a receiver, a utilization-side heat exchanger, and a receiver degassing pipe. The refrigeration apparatus can perform refrigeration cycle operations while extracting, through the receiver degassing pipe, gaseous refrigerant from the receiver to the suction side of the compressor.

BACKGROUND ART

Conventionally, there have been air conditioning apparatuses (refrigeration apparatuses) which include a receiver and a receiver degassing pipe and can perform refrigeration cycle operations while extracting gaseous refrigerant from the receiver to the suction side of a compressor through a receiver degassing pipe. For example, see Japanese Patent Application Publication No. 2010-175190. Furthermore, there have also been air conditioning apparatuses (refrigeration apparatuses) which use a receiver liquid level detection pipe to detect the liquid level in the receiver, e.g., see Japanese Patent Application Publication No. 2006-292212. Here, the detection of the liquid level in the receiver is performed by extracting refrigerant from a predetermined height position in the receiver through the receiver liquid level detection pipe and utilizing a difference in a temperature of the refrigerant flowing through the receiver liquid level detection pipe (i.e., the refrigerant existing at the predetermined height position in the receiver) when the refrigerant is in a gaseous state and a temperature when the refrigerant is in a liquid state to detect whether or not the liquid refrigerant in the receiver has reached the predetermined height position.

SUMMARY

With the above-described conventional refrigeration apparatuses that include a receiver and a receiver degassing pipe, there is the concern that, when the receiver comes close to being full of liquid, the liquid refrigerant will return through the receiver degassing pipe from the receiver to the suction side of the compressor. Therefore, detecting the liquid level and preventing the liquid refrigerant from flowing out through the receiver degassing pipe from the receiver is preferred.

It is conceivable to dispose a receiver liquid level detection pipe in the receiver and detect the liquid level in the receiver in the same manner as the above-described conventional refrigeration apparatuses that use a liquid level detection pipe to detect the liquid level in the receiver.

However, in connection with disposing a receiver liquid level detection pipe in the receiver, if the receiver degassing pipe is made to function as the receiver liquid level detection pipe, then the liquid level in the receiver ends up already reaching the predetermined height position of the receiver degassing pipe at the point in time when the liquid level detection has been performed. Consequently, the liquid refrigerant cannot be prevented from flowing out through the receiver degassing pipe from the receiver. Furthermore, an increase in cost will occur if a receiver liquid level detection pipe is disposed in the receiver separately from the receiver degassing pipe.

It is an object of the present invention to ensure that, in a refrigeration apparatus that includes a receiver and a receiver degassing pipe and can perform refrigeration cycle operations while extracting, gaseous refrigerant from the receiver to the suction side of the compressor through the receiver degassing pipe, the liquid level in the receiver can be detected and an outflow of liquid refrigerant from the receiver degassing pipe can be prevented while controlling as much as possible an increase in cost.

A refrigeration apparatus pertaining to a first aspect is a refrigeration apparatus that includes a compressor, a heat source-side heat exchanger, a receiver, a utilization-side heat exchanger, and a receiver degassing pipe interconnecting the upper portion of the receiver and the suction side of the compressor. The refrigeration apparatus can perform refrigeration cycle operations while extracting gaseous refrigerant from the receiver to the suction side of the compressor through the receiver degassing pipe. Here, a receiver liquid level detection pipe for detecting whether or not the liquid level in the receiver has reached a predetermined position on the lower side of the position where the receiver degassing pipe is connected is connected to the receiver, the receiver liquid level detection pipe merges with the receiver degassing pipe via a capillary tube, and a controller of the refrigeration apparatus detects whether or not the liquid level in the receiver has reached the predetermined position on the lower side of the position where the receiver degassing pipe is connected The controller detects the liquid level using the temperature of the refrigerant flowing though the receiver degassing pipe after the refrigerant extracted from the receiver liquid level detection pipe merges with the refrigerant extracted from the receiver degassing pipe.

Here, as described above, first, the receiver liquid level detection pipe for detecting whether or not the liquid level in the receiver has reached the predetermined position on the lower side of the position where the receiver degassing pipe is connected is disposed in the receiver. For this reason, the liquid level in the receiver can be detected before the liquid level in the receiver reaches the height position of the receiver degassing pipe (i.e., before the receiver comes close to being full of liquid). Moreover, here, as described above, the receiver liquid level detection pipe is merged with the receiver degassing pipe, and the liquid level in the receiver is detected using the temperature of the refrigerant flowing though the receiver degassing pipe after the refrigerant extracted from the receiver liquid level detection pipe merges with the refrigerant extracted from the receiver degassing pipe. Here, because the receiver liquid level detection pipe is merged with the receiver degassing pipe via the capillary pipe, refrigerant having a small flow rate suitable for liquid level detection can be stably extracted from the receiver liquid level detection pipe. That is, most of the receiver degassing pipe doubles as the receiver liquid level detection pipe so that most of the receiver liquid level detection pipe can be dispensed with. For this reason, an increase in cost resulting from disposing the receiver liquid level detection pipe can be controlled compared to a case where the receiver liquid level detection pipe is disposed in the receiver separately from the receiver degassing pipe.

Because of this, here, the liquid level in the receiver can be detected and an outflow of liquid refrigerant from the receiver degassing pipe can be prevented while controlling as much as possible an increase in cost.

A refrigeration apparatus pertaining to a second aspect is the refrigeration apparatus pertaining to the first aspect, wherein the receiver degassing pipe has, on the downstream side of the position where the receiver liquid level detection pipe merges with the receiver degassing pipe, a refrigerant heater that heats the refrigerant flowing through the receiver degassing pipe.

Here, as described above, the receiver degassing pipe has the refrigerant heater on the downstream side of the position where the receiver liquid level detection pipe merges with the receiver degassing pipe. For this reason, the liquid level in the receiver can be detected using the temperature of the refrigerant flowing through the receiver degassing pipe after the refrigerant has been heated by the refrigerant heater. Furthermore, the refrigerant can be heated by the refrigerant heater even if, for example, liquid refrigerant becomes mixed with the refrigerant extracted from the receiver degassing pipe due to some unforeseen cause such as a sudden rise in the liquid level in the receiver. For this reason, an outflow of liquid refrigerant from the receiver degassing pipe can be reliably prevented.

A refrigeration apparatus pertaining to a third aspect is the refrigeration apparatus pertaining to the second aspect, wherein the refrigerant heater is a heat exchanger that uses the high-pressure gaseous refrigerant discharged from the compressor to heat the refrigerant flowing through the receiver degassing pipe.

Here, as described above, a heat exchanger that uses as a heating source the high-pressure gaseous refrigerant discharged from the compressor is employed as the refrigerant heater. For this reason, the temperature difference with the refrigerant extracted from the receiver degassing pipe can be increased compared to a case where a heat exchanger that uses as a heating source the liquid refrigerant flowing out from the receiver is employed as the refrigerant heater, and the ability to heat the refrigerant extracted from the receiver degassing pipe can be improved.

A refrigeration apparatus pertaining to a fourth aspect is the refrigeration apparatus pertaining to the third aspect, wherein part of the heat source-side heat exchanger is a pre-cooling heat exchanger through which the high-pressure gaseous refrigerant discharged from the compressor always flows, a refrigerant cooler that cools an electrical component is connected to the downstream side of the pre-cooling heat exchanger, and the refrigerant heater is connected to the upstream side of the pre-cooling heat exchanger.

Here, as described above, part of the heat source-side heat exchanger is configured by the pre-cooling heat exchanger through which the high-pressure gaseous refrigerant discharged from the compressor always flows, and the refrigerant cooler that cools the electrical component is connected to the downstream side of the pre-cooling heat exchanger, so the electrical component such as a power element that controls a constituent device such as the compressor is cooled.

Additionally, here, utilizing this refrigerant cooling configuration, the refrigerant heater that uses the high-pressure gaseous refrigerant discharged from the compressor to heat the refrigerant flowing through the receiver degassing pipe is connected to the upstream side of the pre-cooling heat exchanger. For this reason, here, the refrigerant heater is disposed splitting off some of the high-pressure gaseous refrigerant discharged from the compressor.

Additionally, in a case where the refrigerant heater is disposed splitting off some of the high-pressure gaseous refrigerant discharged from the compressor in this way, it becomes easier to employ as the refrigerant heater a heat exchanger whose pressure loss is a little large but whose heat exchange performance is high, such as a double-tube heat exchanger, compared to a case where a heat exchanger that uses as a heating source the liquid refrigerant flowing out from the receiver is employed as the refrigerant heater. Because of this, here, the ability to heat the refrigerant extracted from the receiver degassing pipe can be further improved.

A refrigeration apparatus pertaining to a fifth aspect is any of the refrigeration apparatuses pertaining to the first to fourth aspects, wherein the receiver degassing pipe has, on the downstream side of the position where the receiver liquid level detection pipe merges with the receiver degassing pipe, a degassing-side flow rate regulating mechanism that regulates the flow rate of the refrigerant flowing through the receiver degassing pipe.

Here, as described above, the receiver degassing pipe has the degassing-side flow rate regulating mechanism on the downstream side of the position where the receiver liquid level detection pipe merges with the receiver degassing pipe. For this reason, the flow rate of the refrigerant extracted from the receiver degassing pipe can be stably regulated.

DESCRIPTION OF EMBODIMENT

An embodiment of a refrigeration apparatus pertaining to the present invention will be described below on the basis of the drawings. It should be noted that the specific configurations of the refrigeration apparatus pertaining to the present invention are not limited to those in the following embodiment and example modifications thereof, and can be changed without departing from the spirit of the invention.

(1) Configuration of Refrigeration Apparatus (Concurrent Cooling and Heating Operation Type Air Conditioning Apparatus)

Figure 1:
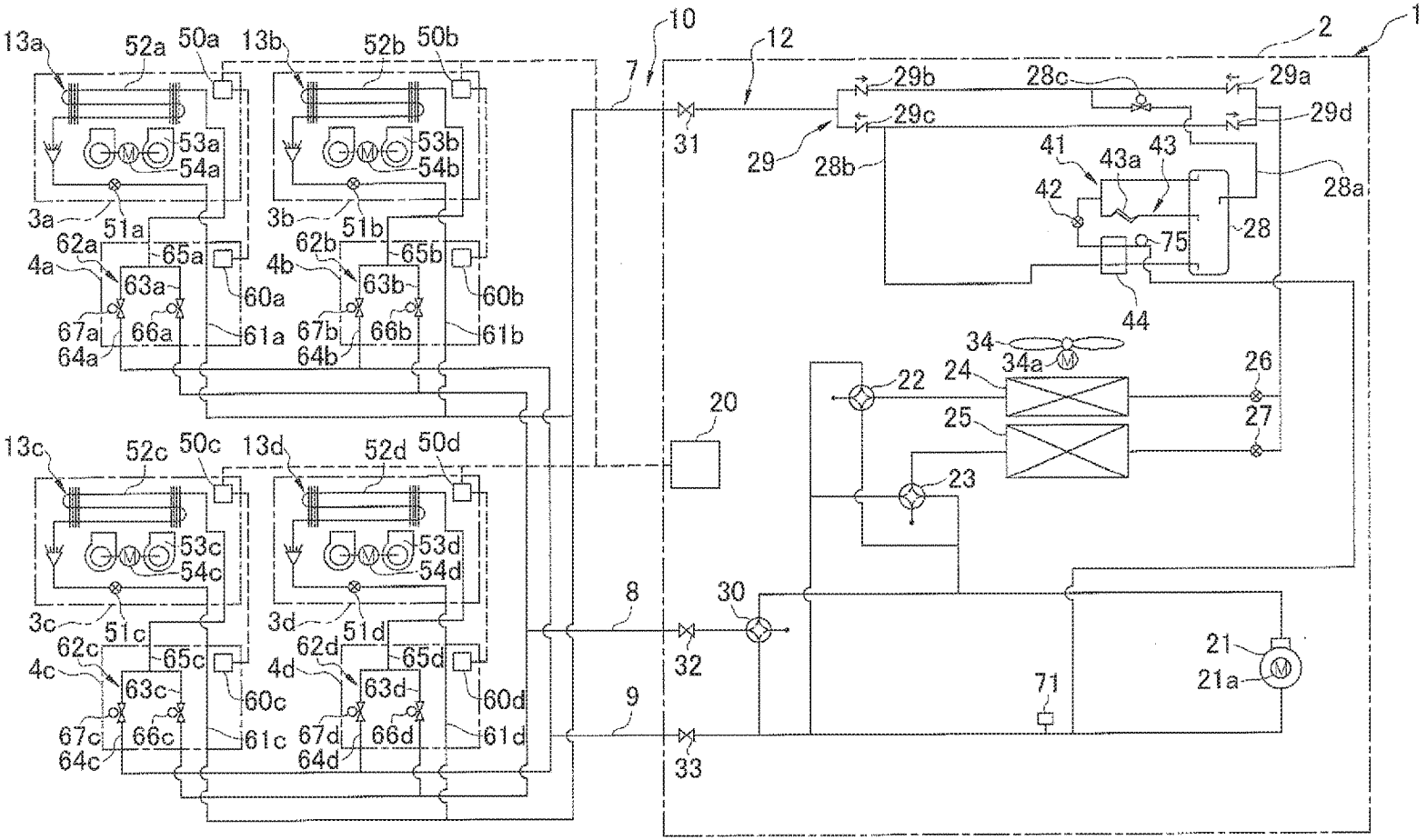
FIG. 1 is a schematic configuration diagram of a concurrent cooling and heating operation type air conditioning apparatus serving as an embodiment of the refrigeration apparatus pertaining to the present invention.

FIG. 1 is a schematic configuration diagram of a concurrent cooling and heating operation type air conditioning apparatus 1 serving as an embodiment of the refrigeration apparatus pertaining to the present invention. The concurrent cooling and heating operation type air conditioning apparatus 1 is an apparatus used to cool and heat rooms in a building, for example, by performing vapor compression refrigeration cycle operations.

The concurrent cooling and heating operation type air conditioning apparatus 1 mainly has one heat source unit 2, plural (here, four) utilization units 3*a*, 3*b*, 3*c*, and 3*d*, connection units 4*a*. 4*b*, 4*c*, and 4*d* connected to the utilization units 3*a*. 3*b*, 3*c*, and 3*d*, and refrigerant connecting pipes 7, 8, and 9 that interconnect the heat source unit 2 and the utilization units 3*a*, 3*b*, 3*c*, and 3*d* via the connection units 4*a*, 4*b*, 4*c*, and 4*d*. That is, a vapor compression refrigerant circuit 10 of the concurrent cooling and heating operation type air conditioning apparatus 1 is configured by the interconnection of the heat source unit 2, the utilization units 3*a*, 3*b*, 3*c*, and 3*d*, the connection units 4*a*, 4*b*, 4*c*, and 4*d*, and the refrigerant connecting pipes 7, 8, and 9. Additionally, the concurrent cooling and heating operation type air conditioning apparatus 1 is configured in such a way that the utilization units 3*a*, 3*b*, 3*c*, and 3*d* can individually perform a cooling operation or a heating operation. Thus, the air conditioning apparatus 1 can perform heat recovery between the utilization units (here, performing a concurrent cooling and heating operation in which it concurrently performs the cooling operation and the heating operation) by delivering refrigerant from utilization units performing the heating operation to utilization units performing the cooling operation. Moreover, the concurrent cooling and heating operation type air conditioning apparatus 1 is configured to balance the heat load of the heat source unit 2 in accordance with the overall heat load of the plural utilization units 3*a*, 3*b*, 3*c*, and 3*d* in consideration also of the above-described heat recovery (concurrent cooling and heating operation).

<Utilization Units>

The utilization units 3*a*. 3*b*, 3*c*, and 3*d* are installed by embedding them in or suspending them from the ceilings of the rooms in the building, for example, or mounting them on the walls of the rooms. The utilization units 3*a*, 3*b*, 3*c*, and 3*d* are connected to the heat source unit 2 via the refrigerant connecting pipes 7, 8, and 9 and the connection units 4*a*, 4*b*, 4*c*, and 4*d*, and configure part of the refrigerant circuit 10.

Next, the configuration of the utilization units 3*a*. 3*b*, 3*c*, and 3*d* will be described. It should be noted that because the utilization unit 3*a* has the same configuration as the utilization units 3*b*, 3*c*, and 3*d*, only the configuration of the utilization unit 3*a* will be described here, and regarding the configurations of the utilization units 3*b*, 3*c*, and 3*d*, the letters "b", "c", or "d" will be assigned instead of the letter "a" appearing in the reference signs indicating the parts of the utilization unit 3*a*, and description of the parts will be omitted.

The utilization unit 3*a* mainly configures part of the refrigerant circuit 10 and has a utilization-side refrigerant circuit 13*a* (the utilization units 3*b*, 3*c*, and 3*d* have utilization-side refrigerant circuits 13*b*, 13*c*, and 13*d*, respectively). The utilization-side refrigerant circuit 13*a* mainly has a utilization-side flow rate regulating valve 51*a* and a utilization-side heat exchanger 52*a*.

The utilization-side flow rate regulating valve 51*a* is an electrically powered expansion valve whose opening degree can be regulated and which is connected to the liquid side of the utilization-side heat exchanger 52*a* in order to regulate the flow rate of the refrigerant flowing through the utilization-side heat exchanger 52*a*.

The utilization-side heat exchanger 52*a* is a device for allowing heat exchange to take place between the refrigerant and the room air, and, for example, comprises a fin-and-tube heat exchanger configured by numerous heat transfer tubes and fins. Here, the utilization unit 3*a* has an indoor fan 53*a* for sucking the room air into the unit, allowing the room air to exchange heat, and thereafter supplying the air to the room as supply air, and the utilization unit 3*a* can cause the room air and the refrigerant flowing through the utilization-side heat exchanger 52*a* to exchange heat. The indoor fan 53*a* is driven by an indoor fan motor 54*a*.

Furthermore, the utilization unit 3*a* has a utilization-side controller 50*a* that controls the actions of the parts 51*a* and 54*a* configuring the utilization unit 3*a*. Additionally, the utilization-side controller 50*a* has a microcomputer and a memory disposed in order to control the utilization unit 3*a*, and the utilization-side controller 50*a* can exchange control signals with a remote controller (not shown in the drawings) and exchange control signals with the heat source unit 2.

<Heat Source Unit>

The heat source unit 2 is installed on the roof of the building, for example, is connected to the utilization units 3*a*, 3*b*, 3*c*, and 3*d*, via the refrigerant connecting pipes 7, 8, and 9, and, with the utilization units 3*a*, 3*b*, 3*c*, and 3*d*, configures the refrigerant circuit 10.

Next, the configuration of the heat source unit 2 will be described. The heat source unit 2 mainly configures part of the refrigerant circuit 10 and has a heat source-side refrigerant circuit 12. The heat source-side refrigerant circuit 12 mainly has a compressor 21, plural (here, two) heat exchange switching mechanisms 22 and 23, plural (here, two) heat source-side heat exchangers 24 and 25, heat source-side flow rate regulating valves 26 and 27 corresponding to the two heat source-side heat exchangers 24 and 25, a receiver 28, a bridge circuit 29, a high/low-pressure switching mechanism 30, a liquid-side stop valve 31, a high/low-pressure gas-side stop valve 32, and a low-pressure gas-side stop valve 33.

The compressor 21 here is a device for compressing the refrigerant, and, for example, comprises a scroll-type or other positive displacement compressor whose operating capacity can be varied by inverter-controlling a compressor motor 21*a*.

The first heat exchange switching mechanism 22 is a device that can switch the flow path of the refrigerant in the heat source-side refrigerant circuit 12 in such a way as to interconnect the discharge side of the compressor 21 and the gas side of the first heat source-side heat exchanger 24 (see the solid lines of the first heat exchange switching mechanism 22 in FIG. 1) to cause the first heat source-side heat exchanger 24 to function as a refrigerant radiator (hereinafter called a "radiation operating state"), and interconnect the suction side of the compressor 21 and the gas side of the first heat source-side heat exchanger 24 (see the dashed lines of the first heat exchange switching mechanism 22 in FIG. 1) to cause the first heat source-side heat exchanger 24 to function as a refrigerant evaporator (hereinafter called an "evaporation operating state"). The first heat exchange switching mechanism 22 comprises, for example, a four-way switching valve. Furthermore, the second heat exchange switching mechanism 23 is a device that can switch the flow path of the refrigerant in the heat source-side refrigerant circuit 12 in such a way as to interconnect the discharge side of the compressor 21 and the gas side of the second heat source-side heat exchanger 25 (see the solid lines of the second heat exchange switching mechanism 23 in FIG. 1) to cause the second heat source-side heat exchanger 25 to function as a refrigerant radiator (hereinafter called a "radiation operating state"), and interconnect the suction side of the compressor 21 and the gas side of the second heat source-side heat exchanger 25 (see the dashed lines of the second heat exchange switching mechanism 23 in FIG. 1) to cause the second heat source-side heat exchanger 25 to function as a refrigerant evaporator (hereinafter called an "evaporation operating state"). The second heat exchange switching mechanism 23 comprises, for example, a four-way switching valve. Additionally, by changing the switching states of the first heat exchange switching mechanism 22 and the second heat exchange switching mechanism 23, the first heat source-side heat exchanger 24 and the second heat source-side heat exchanger 25 can be switched in such a way as to cause them to individually function as a refrigerant evaporator or radiator.

The first heat source-side heat exchanger 24 is a device for allowing heat exchange to take place between the refrigerant and outdoor air, and, for example, comprises a fin-and-tube heat exchanger configured by numerous heat transfer tubes and fins. The gas side of the first heat source-side heat exchanger 24 is connected to the first heat exchange switching mechanism 22, and the liquid side of the first heat source-side heat exchanger 24 is connected to the first heat source-side flow rate regulating valve 26. Furthermore, the second heat source-side heat exchanger 25 is a device for allowing heat exchange to take place between the refrigerant and outdoor air, and, for example, comprises a fin-and-tube heat exchanger configured by numerous heat transfer tubes and fins. The gas side of the second heat source-side heat exchanger 25 is connected to the second heat exchange switching mechanism 23, and the liquid side of the second heat source-side heat exchanger 25 is connected to the second heat source-side flow rate regulating valve 27. Here, the first heat source-side heat exchanger 24 and the second heat source-side heat exchanger 25 are configured as an integrated heat source-side heat exchanger. Additionally, the heat source unit 2 has an outdoor fan 34 for sucking the outdoor air into the unit, allowing the outdoor air to exchange heat, and thereafter expelling the outdoor air to the outside of the unit, and the heat source unit 2 can cause the outdoor air and the refrigerant flowing through the heat source-side heat exchangers 24 and 25 to exchange heat. The outdoor fan 34 is driven by an outdoor fan motor 34*a* whose rotational speed can be controlled.

The first heat source-side flow rate regulating valve 26 is an electrically powered expansion valve whose opening degree can be regulated and which is connected to the liquid side of the first heat source-side heat exchanger 24 in order to regulate the flow rate of the refrigerant flowing through the first heat source-side heat exchanger 24. Furthermore, the second heat source-side flow rate regulating valve 27 is an electrically powered expansion valve whose opening degree can be regulated and which is connected to the liquid side of the second heat source-side heat exchanger 25 in order to regulate the flow rate of the refrigerant flowing through the second heat source-side heat exchanger 25.

The receiver 28 is a container for temporarily accumulating the refrigerant flowing between the heat source-side heat exchangers 24 and 25 and the utilization-side refrigerant circuits 13*a*, 13*b*, 13*c*, and 13*d* A receiver inlet pipe 28*a* is disposed in the upper portion of the receiver 28, and a receiver outlet pipe 28*b* is disposed in the lower portion of the receiver 28. Furthermore, a receiver inlet opening and closing valve 28*c* whose opening and closing can be controlled is disposed in the receiver inlet pipe 28*a*. Additionally, the inlet pipe 28*a* and the outlet pipe 28*b* of the receiver 28 are connected between the heat source-side heat exchangers 24 and 25 and the liquid-side stop valve 31 via the bridge circuit 29.

Furthermore, a receiver degassing pipe 41 is connected to the receiver 28. The receiver degassing pipe 41 is disposed so as to extract refrigerant from the upper portion of the receiver 28 separately from the receiver inlet pipe 28*a*, and interconnects the upper portion of the receiver 28 and the suction side of the compressor 21. A degassing-side flow rate regulating valve 42 serving as a degassing-side flow rate regulating mechanism is disposed in the receiver degassing pipe 41 in order to regulate the flow rate of the refrigerant degassed from the receiver 28. Here, the degassing-side flow rate regulating valve 42 comprises an electrically powered expansion valve whose opening degree can be regulated.

Figure 2:
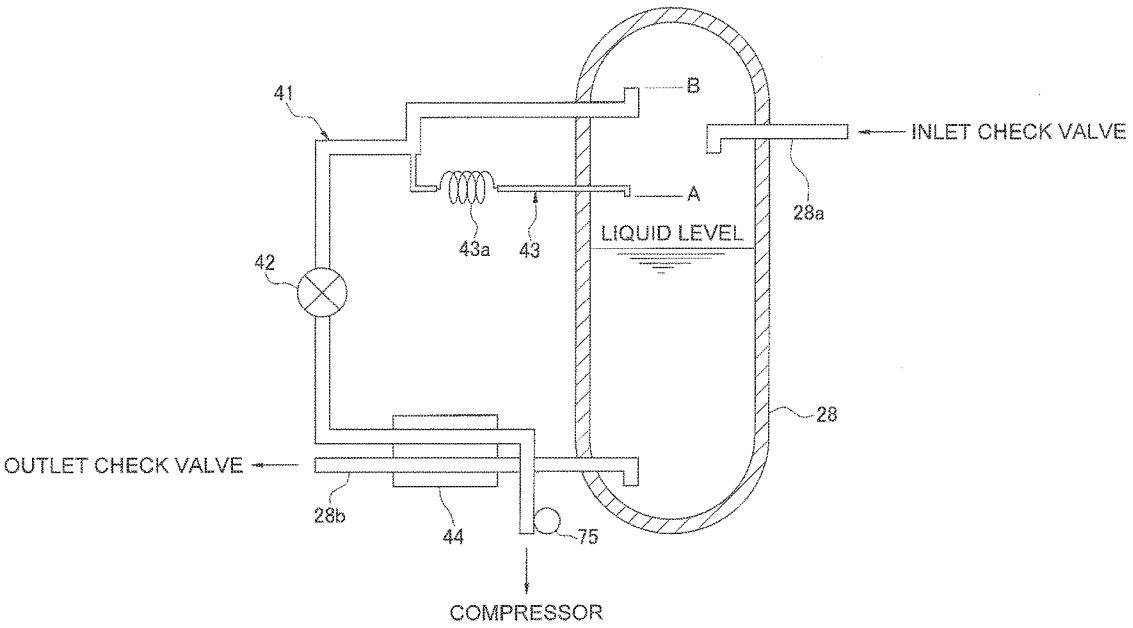
FIG. 2 is a schematic diagram showing the structure of a receiver and the area around the receiver.

Furthermore, as shown in FIG. 2, a receiver liquid level detection pipe 43 for detecting whether or not the liquid level in the receiver 28 has reached a predetermined position A on the lower side of the position where the receiver degassing pipe 41 is connected is connected to the receiver 28. Here, the receiver liquid level detection pipe 43 is disposed so as to extract the refrigerant from the section near the up and down direction middle of the receiver 28. Additionally, the receiver liquid level detection pipe 43 merges with the receiver degassing pipe 41 and includes a capillary tube 43*a*. Here, the receiver liquid level detection pipe 43 is disposed so as to merge with the section of the receiver degassing pipe 41 on the upstream side of the position where the degassing-side flow rate regulating valve 42 is disposed. Moreover, a refrigerant heater 44 that heats the refrigerant flowing through the receiver degassing pipe 41 is disposed on the receiver degassing pipe 41 on the downstream side of the position where the receiver liquid level detection pipe 43 merges with the receiver degassing pipe 41. Here, the refrigerant heater 44 is a heat exchanger that heats the refrigerant flowing through the receiver degassing pipe 41 using as a heating source the refrigerant flowing through the receiver outlet pipe 28*b*. The refrigerant heater 44 comprises, for example, a pipe heat exchanger configured by bringing the receiver outlet pipe 28*b* and the receiver degassing pipe 41 into contact with each other.

The bridge circuit 29 is a circuit having the function of allowing the refrigerant to flow through the receiver inlet pipe 28*a* and into the receiver 28 and allowing the refrigerant to flow through the receiver outlet pipe 28*b* and out from the receiver 28 both when the refrigerant flows from the heat source-side heat exchangers 24 and 25 to the liquid-side stop valve 31 and when the refrigerant flows from the liquid-side stop valve 31 to the heat source-side heat exchangers 24 and 25. The bridge circuit 29 has four check valves 29*a*, 29*b*, 29*c*, and 29*d*. Additionally, the inlet check valve 29*a* is a check valve that only allows the refrigerant to circulate from the heat source-side heat exchangers 24 and 25 to the receiver inlet pipe 28*a* The inlet check valve 29*b* is a check valve that only allows the refrigerant to circulate from the liquid-side stop valve 31 to the receiver inlet pipe 28*a*. That is, the inlet check valves 29*a* and 29*b* have the function of allowing the refrigerant to circulate from the heat source-side heat exchangers 24 and 25 or the liquid-side stop valve 31 to the receiver inlet pipe 28*a*. The outlet check valve 29*c* is a check valve that only allows the refrigerant to circulate from the receiver outlet pipe 28*b* to the liquid-side stop valve 31. The outlet check valve 29*d* is a check valve that only allows the refrigerant to circulate from the receiver outlet pipe 28*b* to the heat source-side heat exchangers 24 and 25. That is, the outlet check valves 29*c* and 29*d* have the function of allowing the refrigerant to circulate from the receiver outlet pipe 28*b* to the heat source-side heat exchangers 24 and 25 or the liquid-side stop valve 31.

The high/low-pressure switching mechanism 30 is a device that can switch the flow path of the refrigerant in the heat source-side refrigerant circuit 12 in such a way as to interconnect the discharge side of the compressor 21 and the high/low-pressure gas-side stop valve 32 (see the dashed lines of the high/low-pressure switching mechanism 30 in FIG. 1) to deliver the high-pressure gaseous refrigerant discharged from the compressor 21 to the utilization-side refrigerant circuits 13*a*, 13*b*, 13*c*, and 13*d* (hereinafter called a "radiation load-predominant operating state"), and interconnect the high/low-pressure gas-side stop valve 32 and the suction side of the compressor 21 (see the solid lines of the high/low-pressure switching mechanism 30 in FIG. 1) to deliver the high-pressure gaseous refrigerant discharged from the compressor 21 to the utilization-side refrigerant circuits 13*a*, 13*b*, 13*c*, and 13*d* (hereinafter called an "evaporation load-predominant operating state"). The high/low pressure switching mechanism 30 comprises, for example, a four-way switching valve.

The liquid-side stop valve 31, the high/low-pressure gas-side stop valve 32, and the low-pressure gas-side stop valve 33 are valves disposed in openings connected to outside devices and pipes (specifically, the refrigerant connecting pipes 7, 8, and 9). The liquid-side stop valve 31 is connected to the receiver inlet pipe 28*a* or the receiver outlet pipe 28*b* via the bridge circuit 29. The high/low-pressure gas-side stop valve 32 is connected to the high/low-pressure switching mechanism 30. The low-pressure gas-side stop valve 33 is connected to the suction side of the compressor 21.

Furthermore, various types of sensors are disposed in the heat source unit 2. Specifically, a suction pressure sensor 71, which detects the pressure of the refrigerant on the suction side of the compressor 21, and a degassing-side temperature sensor 75, which detects the temperature of the refrigerant flowing through the receiver degassing pipe 41, are disposed. Here, the degassing-side temperature sensor 75 is disposed in the receiver degassing pipe 41 so as to detect the temperature of the refrigerant at the outlet of the refrigerant heater 44. Furthermore, the heat source unit 2 has a heat source-side controller 20 that controls the actions of the parts 21*a*, 22, 23, 26, 27, 28*c*, 30, 34*a*, and 41 configuring the heat source unit 2. Additionally, the heat source-side controller 20 has a microcomputer and a memory disposed in order to control the heat source unit 2, and can exchange control signals and so forth with the utilization-side controllers 50*a*, 50*b*, 50*c*, and 50*d* of the utilization units 3*a*, 3*b*, 3*c*, and 3*d*.

<Connection Units>

The connection units 4*a*, 4*b*, 4*c*, and 4*d* are installed together with the utilization units 3*a*, 3*b*, 3*c*, and 3*d* in the rooms of the building, for example. Together with the refrigerant connecting pipes 7, 8, and 9, the connection units 4*a*, 4*b*, 4*c*, and 4*d* are interposed between the utilization units 3, 4, and 5 and the heat source unit 2 and configure part of the refrigerant circuit 10.

Next, the configuration of the connection units 4*a*, 4*b*, 4*c*, and 4*d* will be described. It should be noted that because the connection unit 4*a* has the same configuration as the connection units 4*b*, 4*c*, and 4*d*, only the configuration of the connection unit 4*a* will be described here, and regarding the configurations of the connection units 4*b*, 4*c*, and 4*d*, the letters "b", "c", or "d" will be assigned instead of the letter "a" appearing in the reference signs indicating the parts of the connection unit 4*a*, and description of the parts will be omitted.

The connection unit 4*a* mainly configures part of the refrigerant circuit 10 and has a connection-side refrigerant circuit 14*a* (the connection units 4*b*, 4*c*, and 4*d* have connection-side refrigerant circuits 14*b*, 14*c*, and 14*d*, respectively). The connection-side refrigerant circuit 14*a* mainly has a liquid connection pipe 61*a* and a gas connection pipe 62*a*.

The liquid connection pipe 61*a* interconnects the liquid refrigerant connecting pipe 7 and the utilization-side flow rate regulating valve 51*a* of the utilization-side refrigerant circuit 13*a*.

The gas connection pipe 62*a* has a high-pressure gas connection pipe 63*a* connected to the high/low-pressure gaseous refrigerant connecting pipe 8, a low-pressure gas connection pipe 64*a* connected to the low-pressure gaseous refrigerant connecting pipe 9, and a merging gas connection pipe 65*a* that merges together the high-pressure gas connection pipe 63*a* and the low-pressure gas connection pipe 64*a*. The merging gas connection pipe 65*a* is connected to the gas side of the utilization-side heat exchanger 52*a* of the utilization-side refrigerant circuit 13*a*. A high-pressure gas opening and closing valve 66*a* whose opening and closing can be controlled is disposed in the high-pressure gas connection pipe 63*a*, and a low-pressure gas opening and closing valve 67*a* whose opening and closing can be controlled is disposed in the low-pressure gas connection pipe 64*a*.

Additionally, when the utilization unit 3*a* performs the cooling operation, the low-pressure gas opening and closing valve 67*a* is opened so that the connection unit 4*a* can function to deliver the refrigerant flowing through the liquid refrigerant connecting pipe 7 and into the liquid connection pipe 61*a* through the utilization-side flow rate regulating valve 51*a* of the utilization-side refrigerant circuit 13*a* to the utilization-side heat exchanger 52*a* and return the refrigerant that has evaporated as a result of exchanging heat with the room air in the utilization-side heat exchanger 52*a* through the merging gas connection pipe 65*a* and the low-pressure gas connection pipe 64*a* to the low-pressure gaseous refrigerant connecting pipe 9. Furthermore, when the utilization unit 3*a* performs the heating operation, the low-pressure gas opening and closing valve 67*a* is closed and the high-pressure gas opening and closing valve 66*a* is opened so that the connection unit 4*a* can function to deliver the refrigerant flowing through the high/low-pressure gas refrigerant connecting pipe 8 and into the high-pressure gas connection pipe 63*a* and the merging gas connection pipe 65*a* to the utilization-side heat exchanger 52*a* of the utilization-side refrigerant circuit 13*a* and return the refrigerant that has radiated heat as a result of exchanging heat with the room air in the utilization-side heat exchanger 52*a* through the utilization-side flow rate regulating valve 51*a* and the liquid connection pipe 61*a* to the liquid refrigerant connecting pipe 7. Not just the connection unit 4*a* but also the connection units 4*b*, 4*c*, and 4*d* likewise have this function, so the utilization-side heat exchangers 52*a*, 52*b*. 52*c*, and 52*d* can be individually switched, by the connection units 4*a*, 4*b*, 4*c*, and 4*d*, to cause them to individually function as a refrigerant evaporator or radiator.

Furthermore, the connection unit 4*a* has a connection-side controller 60*a* that controls the actions of the parts 66*a* and 67*a* configuring the connection unit 4*a*. Additionally, the connection-side controller 60*a* has a microcomputer and a memory disposed in order to control the connection unit 60*a*, and can exchange control signals and so forth with the utilization-side controller 50*a* of the utilization unit 3*a*.

As described above, the refrigerant circuit 10 of the concurrent cooling and heating operation type air conditioning apparatus 1 is configured by the interconnection of the utilization-side refrigerant circuits 13*a*, 13*b*, 13*c*, and 13*d*, the heat source-side refrigerant circuit 12, the refrigerant connecting pipes 7, 8, and 9, and the connection-side refrigerant circuits 14*a*, 14*b*, 14*c*, and 14*d*. Additionally, the concurrent cooling and heating operation type air conditioning apparatus 1 configures a refrigeration apparatus having a refrigerant circuit including the compressor 21, the heat source-side heat exchangers 24 and 25, the receiver 28, the utilization-side heat exchangers 52*a*, 52*b*, 52*c*, and 52*d*, and the receiver degassing pipe 41 that interconnects the upper portion of the receiver 28 and the suction side of the compressor 21. Additionally, here, as described later, the refrigeration apparatus can perform refrigeration cycle operations while extracting, through the receiver degassing pipe 41, gaseous refrigerant from the receiver 28 to the suction side of the compressor 21. Moreover, here, as described above, the receiver liquid level detection pipe 43 for detecting whether or not the liquid level in the receiver 28 has reached the predetermined position A on the lower side of the position where the receiver degassing pipe 41 is connected is connected to the receiver 28. Also, the receiver liquid level detection pipe 43 merges with the receiver degassing pipe 41 and includes the capillary tube 43*a*. Consequently, as described later, the refrigeration apparatus detects whether or not the liquid level in the receiver 28 has reached the predetermined position A on the lower side of the position where the receiver degassing pipe 41 is connected, using the temperature of the refrigerant flowing through the receiver degassing pipe 41 after the refrigerant extracted from the receiver liquid level detection pipe 43 merges with the refrigerant extracted from the receiver degassing pipe 41.

(2) Actions of Refrigeration Apparatus (Concurrent Cooling and Heating Operation Type Air Conditioning Apparatus)

Next, the actions of the concurrent cooling and heating operation type air conditioning apparatus 1 will be described.

The refrigeration cycle operations of the concurrent cooling and heating operation type air conditioning apparatus 1 include a cooling operation, a heating operation, a concurrent cooling and heating operation (evaporation load-predominant), and a concurrent cooling and heating operation (radiation load-predominant). Here, the cooling operation is an operation in which there are just utilization units performing the cooling operation (i.e., an operation in which the utilization-side heat exchangers function as refrigerant evaporators) and in which the heat source-side heat exchangers 24 and 25 function as refrigerant radiators with respect to the overall evaporation load of the utilization units. The heating operation is an operation in which there are just utilization units performing the heating operation (i.e., an operation in which the utilization-side heat exchangers function as refrigerant radiators) and in which the heat source-side heat exchangers 24 and 25 function as refrigerant evaporators with respect to the overall radiation load of the utilization units. The concurrent cooling and heating operation (evaporation load-predominant) is an operation in which there is a mix of utilization units performing the cooling operation (i.e., an operation in which the utilization-side heat exchangers function as refrigerant evaporators) and utilization units performing the heating operation (i.e., an operation in which the utilization-side heat exchangers function as refrigerant radiators) and in which, in a case where the overall heat load of the utilization units is evaporation load-predominant, the heat source-side heat exchangers 24 and 25 function as refrigerant radiators with respect to the overall evaporation load of the utilization units. The concurrent cooling and heating operation (radiation load-predominant) is an operation in which there is a mix of utilization units performing the cooling operation (i.e., an operation in which the utilization-side heat exchangers function as refrigerant evaporators) and utilization units performing the heating operation (i.e., an operation in which the utilization-side heat exchangers function as refrigerant radiators) and in which, in a case where the overall heat load of the utilization units is radiation load-predominant, the heat source-side heat exchangers 24 and 25 function as refrigerant evaporators with respect to the overall radiation load of the utilization units.

It should be noted that the actions of the concurrent cooling and heating operation type air conditioning apparatus 1 including these refrigeration cycle operations are performed by the controllers 20, 50*a*, 50*b*, 50*c*, 50*d*, 60*a*, 60*b*, 60*c*, and 60*d*.

—Cooling Operation—

Figure 3:
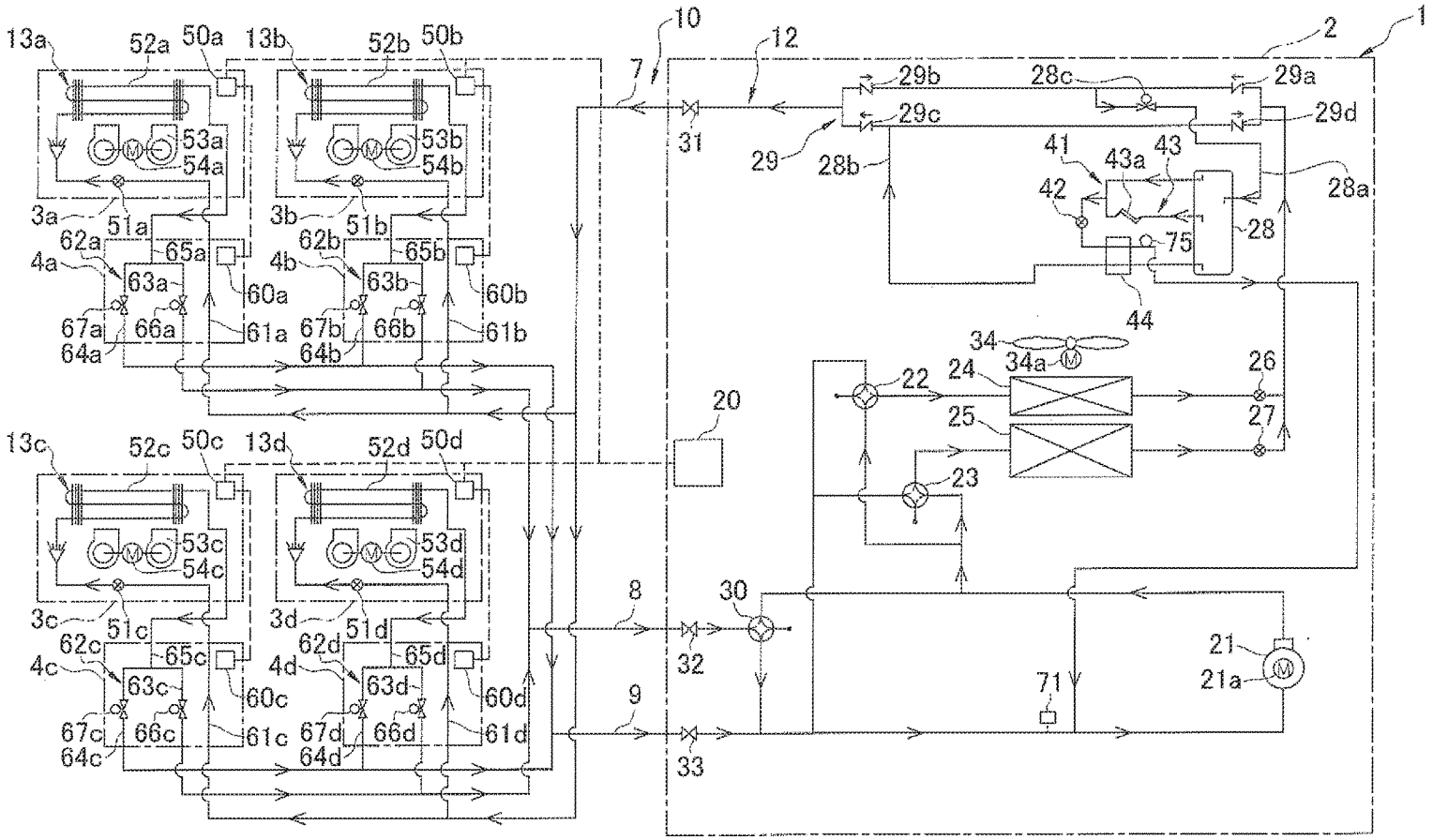
FIG. 3 is a diagram showing actions (the flow of refrigerant) in a cooling operation.

In the cooling operation, when, for example, all of the utilization units 3*a*, 3*b*, 3*c*, and 3*d* perform the cooling operation (i.e., an operation in which all of the utilization-side heat exchangers 52*a*, 52*b*, 52*c*, and 52*d* function as refrigerant evaporators) and the heat source-side heat exchangers 24 and 25 function as refrigerant radiators, the refrigerant circuit 10 of the air conditioning apparatus 1 is configured as shown in FIG. 3 (for the flow of the refrigerant, see the arrows added to the refrigerant circuit 10 in FIG. 3).

Specifically, in the heat source unit 2, the first heat exchange switching mechanism 22 is switched to the radiation operating state (the state indicated by the solid lines of the first heat exchange switching mechanism 22 in FIG. 3) and the second heat exchange switching mechanism 23 is switched to the radiation operating state (the state indicated by the solid lines of the second heat exchange switching mechanism 23 in FIG. 3) to cause the heat source-side heat exchangers 24 and 25 to function as refrigerant radiators. Furthermore, the high/low-pressure switching mechanism 30 is switched to the evaporation load-predominant operating state (the state indicated by the solid lines of the high-low-pressure switching mechanism 30 in FIG. 3). Furthermore, the heat source-side flow rate regulating valves 26 and 27 have their opening degrees regulated, and the receiver inlet opening and closing valve 28*c* is opened. Moreover, the opening degree of the degassing-side flow rate regulating valve 42 serving as a degassing-side flow rate regulating mechanism is regulated, so that the gaseous refrigerant is extracted, through the receiver degassing pipe 41, from the receiver 28 to the suction side of the compressor 21. In the connection units 4*a*, 4*b*, 4*c*, and 4*d*, the high-pressure gas opening and closing valves 66*a*, 66*b*, 66*c*, and 66*d* and the low-pressure gas opening and closing valves 67*a*, 67*b*, 67*c*, and 67*d* are opened to cause all of the utilization-side heat exchangers 52*a*, 52*b*, 52*c*, and 52*d* of the utilization units 3*a*, 3*b*, 3*c*, and 3*d* to function as refrigerant evaporators, and all of the utilization-side heat exchangers 52*a*, 52*b*, 52*c*, and 52*d* of the utilization units 3*a*, 3*b*, 3*c*, and 3*d* become connected to the suction side of the compressor 21 of the heat source unit 2 via the high/low-pressure gaseous refrigerant connecting pipe 8 and the low-pressure gaseous refrigerant connecting pipe 9. In the utilization units 3*a*, 3*b*, 3*c*, and 3*d*, the utilization-side flow rate regulating valves 51*a*, 51*b*, 51*c*, and 51*d* have their opening degrees regulated.

In this refrigerant circuit 10, the high-pressure gaseous refrigerant compressed in and discharged from the compressor 21 travels through the heat exchange switching mechanisms 22 and 23 and is delivered to the heat source-side heat exchangers 24 and 25. Then, the high-pressure gaseous refrigerant delivered to the heat source-side heat exchangers 24 and 25 radiates heat as a result of exchanging heat with the outdoor air serving as a heat source supplied by the outdoor fan 34 in the heat source-side heat exchangers 24 and 25. Then, the refrigerant that has radiated heat in the heat source-side heat exchangers 24 and 25 has its flow rate regulated in the heat source-side flow rate regulating valves 26 and 27, merges together, travels through the inlet check valve 29*a* and the receiver inlet opening and closing valve 28*c*, and is delivered to the receiver 28. Then, the refrigerant delivered to the receiver 28 is temporarily accumulated and separated into gaseous refrigerant and liquid refrigerant in the receiver 28, and thereafter the gaseous refrigerant is extracted through the receiver degassing pipe 41 to the suction side of the compressor 21 while the liquid refrigerant travels through the outlet check valve 29*c* and the liquid-side stop valve 31 and is delivered to the liquid refrigerant connecting pipe 7.

Then, the refrigerant delivered to the liquid refrigerant connecting pipe 7 is split into four flows and delivered to the liquid connection pipes 61*a*, 61*b*, 61*c*, and 61*d* of the connection units 4*a*, 4*b*, 4*c*, and 4*d*. Then, the refrigerant delivered to the liquid connection pipes 61*a*, 61*b*, 61*c*, and 61*d* is delivered to the utilization-side flow rate regulating valves 51*a*, 51*b*, 51*c*, and 51*d* of the utilization units 3*a*, 3*b*, 3*c*, and 3*d*.

Then, the refrigerant delivered to the utilization-side flow rate regulating valves 51*a*, 51*b*, 51*c*, and 51*d* has its flow rate regulated in the utilization-side flow rate regulating valves 51*a*, 51*b*, 51*c*, and 51*d* and thereafter evaporates as a result of exchanging heat with the room air supplied by the indoor fans 53*a*, 53*b*, 53*c*, and 53*d* and becomes low-pressure gaseous refrigerant in the utilization-side heat exchangers 52*a*, 52*b*, 52*c*, and 52*d*. Meanwhile, the room air is cooled and supplied to the rooms, so that the cooling operation of the utilization units 3*a*, 3*b*. 3*c*, and 3*d* is performed. Then, the low-pressure gaseous refrigerant is delivered to the merging gas connection pipes 65*a*. 65*b*, 65*c*, and 65*d* of the connection units 4*a*, 4*b*, 4*c*, and 4*d*.

Then, the low-pressure gaseous refrigerant delivered to the merging gas connection pipes 65*a*, 65*b*, 65*c*, and 65*d* travels through the high-pressure gas opening and closing valves 66*a*, 66*b*, 66*c*, and 66*d* and the high-pressure gas connection pipes 63*a*, 63*b*, 63*c*, and 63*d* and is delivered to and merges together in the high/low-pressure gaseous refrigerant connecting pipe 8 and also travels through the low-pressure gas opening and closing valves 67*a*, 67*b*, 67*c*, and 67*d* and the low-pressure gas connection pipes 64*a*, 64*b*, 64*c*, and 64*d* and is delivered to and merges together in the low-pressure gaseous refrigerant connecting pipe 9.

Then, the low-pressure gaseous refrigerant delivered to the gaseous refrigerant connecting pipes 8 and 9 travels through the gas-side stop valves 32 and 33 and the high/low-pressure switching mechanism 30 and is returned to the suction side of the compressor 21.

In this way, the actions in the cooling operation are performed. It should be noted that in a case where the overall evaporation load of the utilization-side heat exchangers 52*a*, 52*b*, 52*c*, and 52*d* becomes smaller as a result, for example, of some of the utilization units 3*a*, 3*b*, 3*c*, and 3*d* performing the cooling operation (i.e., an operation in which some of the utilization-side heat exchangers 52*a*, 52*b*, 52*c*, and 52*d* function as refrigerant evaporators), an operation that causes just one of the heat source-side heat exchangers 24 and 25 (e.g., the first heat source-side heat exchanger 24) to function as a refrigerant radiator is performed.

—Heating Operation—

Figure 4:
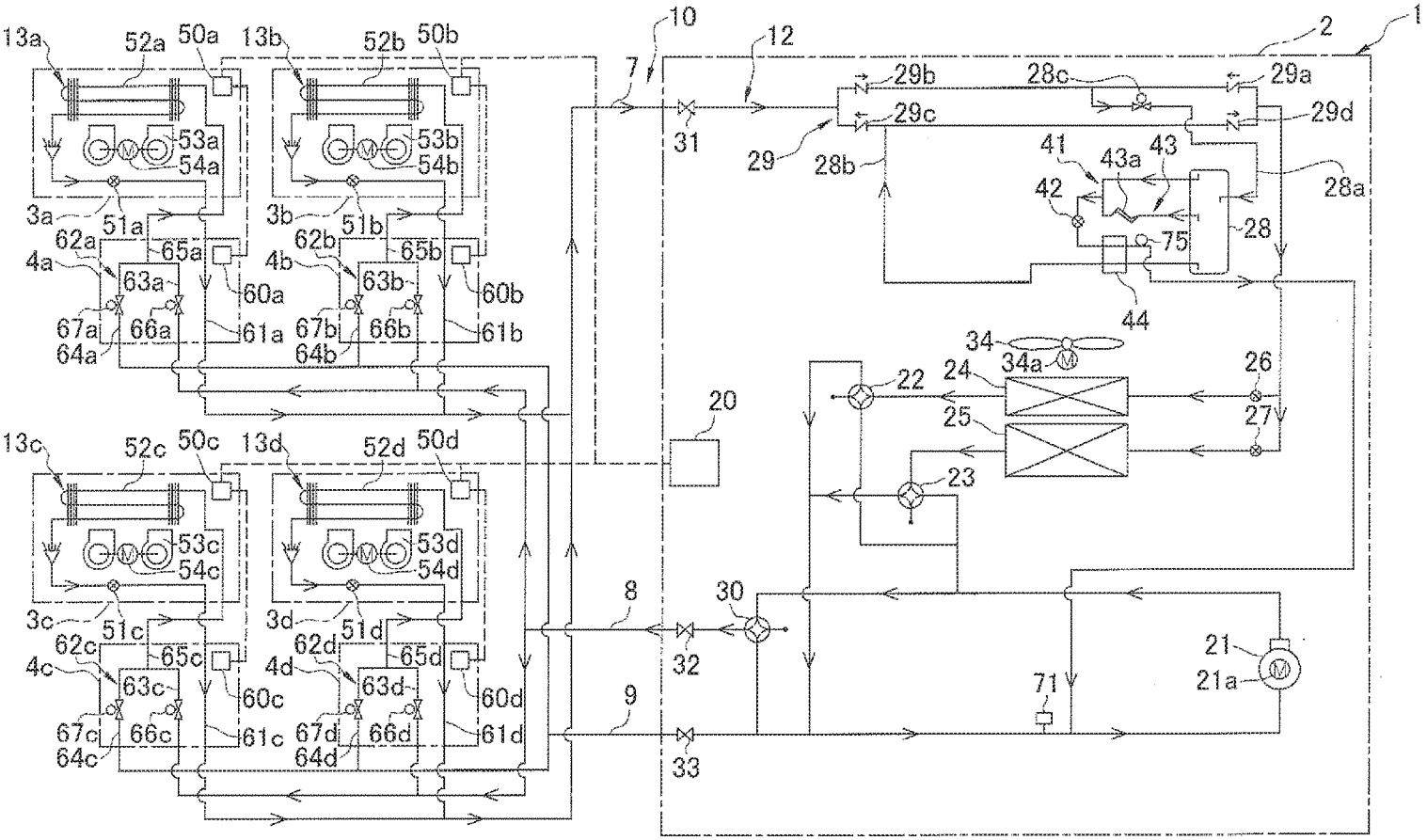
FIG. 4 is a diagram showing actions (the flow of refrigerant) in a heating operation.

In the heating operation, when, for example, all of the utilization units 3*a*, 3*b*, 3*c*, and 3*d* perform the heating operation (i.e., an operation in which all of the utilization-side heat exchangers 52*a*, 52*b*, 52*c*, and 52*d* function as refrigerant radiators) and the heat source-side heat exchangers 24 and 25 function as refrigerant evaporators, the refrigerant circuit 10 of the air conditioning apparatus 1 is configured as shown in FIG. 4 (for the flow of the refrigerant, see the arrows added to the refrigerant circuit 10 in FIG. 4).

Specifically, in the heat source unit 2, the first heat exchange switching mechanism 22 is switched to the evaporation operating state (the state indicated by the dashed lines of the first heat exchange switching mechanism 22 in FIG. 4) and the second heat exchange switching mechanism 23 is switched to the evaporation operating state (the state indicated by the dashed lines of the second heat exchange switching mechanism 23 in FIG. 4) to cause the heat source-side heat exchangers 24 and 25 to function as refrigerant evaporators. Furthermore, the high/low-pressure switching mechanism 30 is switched to the radiation load-predominant operating state (the state indicated by the dashed lines of the high/low-pressure switching mechanism 30 in FIG. 4). Furthermore, the heat source-side flow rate regulating valves 26 and 27 have their opening degrees regulated, and the receiver inlet opening and closing valve 28*c* is opened. Moreover, the opening degree of the degassing-side flow rate regulating valve 42 serving as a degassing-side flow rate regulating mechanism is regulated, so that the gaseous refrigerant is extracted, through the receiver degassing pipe 41, from the receiver 28 to the suction side of the compressor 21. In the connection units 4*a*, 4*b*, 4*c*, and 4*d*, the high-pressure gas opening and closing valves 66*a*, 66*b*, 66*c*, and 66*d* are opened and the low-pressure gas opening and closing valves 67*a*, 67*b*, 67*c*, and 67*d* are closed to cause all of the utilization-side heat exchangers 52*a*, 52*b*, 52*c*, and 52*d* of the utilization units 3*a*. 3*b*, 3*c*, and 3*d* to function as refrigerant radiators, and all of the utilization-side heat exchangers 52*a*, 52*b*, 52*c*, and 52*d* of the utilization units 3*a*, 3*b*, 3*c*, and 3*d* become connected to the discharge side of the compressor 21 of the heat source unit 2 via the high/low-pressure gaseous refrigerant connecting pipe 8. In the utilization units 3*a*, 3*b*, 3*c*, and 3*d*, the utilization-side flow rate regulating valves 51*a*, 51*b*, 51*c*, and 51*d* have their opening degrees regulated.

In this refrigerant circuit 10, the high-pressure gaseous refrigerant compressed in and discharged from the compressor 21 travels through the high/low-pressure switching mechanism 30 and the high/low-pressure gas-side stop valve 32 and is delivered to the high/low-pressure gaseous refrigerant connecting pipe 8.

Then, the high-pressure gaseous refrigerant delivered to the high/low-pressure gaseous refrigerant connecting pipe 8 is split into four flows and delivered to the high-pressure gas connection pipes 63*a*, 63*b*. 63*c*, and 63*d* of the connection units 4*a*, 4*b*, 4*c*, and 4*d*. The high-pressure gaseous refrigerant delivered to the high-pressure gas connection pipes

63*a*, 63*b*, 63*c*, and 63*d* travels through the high-pressure gas opening and closing valves 66*a*, 66*b*. 66*c*, and 66*d* and the merging gas connection pipes 65*a*, 65*b*. 65*c*, and 65*d* and is delivered to the utilization-side heat exchangers 52*a*, 52*b*, 52*c*, and 52*d* of the utilization units 3*a*. 3*b*, 3*c*, and 3*d*.

Then, the high-pressure gaseous refrigerant delivered to the utilization-side heat exchangers 52*a*, 52*b*, 52*c*, and 52*d* radiates heat as a result of exchanging heat with the room air supplied by the indoor fans 53*a*, 53*b*, 53*c*, and 53*d* in the utilization-side heat exchangers 52*a*, 52*b*, 52*c*, and 52*d*. Meanwhile, the room air is heated and supplied to the rooms, so that the heating operation of the utilization units 3*a*, 3*b*, 3*c*, and 3*d* is performed. The refrigerant that has radiated heat in the utilization-side heat exchangers 52*a*, 52*b*, 52*c*, and 52*d* has its flow rate regulated in the utilization-side flow rate regulating valves 51*a*, 51*b*, 51*c*, and 51*d* and thereafter is delivered to the liquid connection pipes 61*a*, 61*b*, 61*c*, and 61*d* of the connection units 4*a*, 4*b*, 4*c*, and 4*d*.

Then, the refrigerant delivered to the liquid connection pipes 61*a*, 61*b*, 61*c*, and 61*d* is delivered to and merges together in the liquid refrigerant connecting pipe 7.

Then, the refrigerant delivered to the liquid refrigerant connecting pipe 7 travels through the liquid-side stop valve 31, the inlet check valve 29*b*, and the receiver inlet opening and closing valve 28*c* and is delivered to the receiver 28. The refrigerant delivered to the receiver 28 is temporarily accumulated and separated into gaseous refrigerant and liquid refrigerant in the receiver 28, and thereafter the gaseous refrigerant is extracted through the receiver degassing pipe 41 to the suction side of the compressor 21 while the liquid refrigerant is delivered through the outlet check valve 29*d* to both of the heat source-side flow rate regulating valves 26 and 27. Then, the refrigerant delivered to the heat source-side flow rate regulating valves 26 and 27 has its flow rate regulated in the heat source-side flow rate regulating valves 26 and 27, thereafter evaporates as a result of exchanging heat with the outdoor air supplied by the outdoor fan 34 and becomes low-pressure gaseous refrigerant in the heat source-side heat exchangers 24 and 25, and is delivered to the heat exchange switching mechanisms 22 and 23. Then, the low-pressure gaseous refrigerant delivered to the heat exchange switching mechanisms 22 and 23 merges together and is returned to the suction side of the compressor 21.

In this way, the actions in the heating operation are performed. It should be noted that in a case where the overall radiation load of the utilization-side heat exchangers 52*a*, 52*b*, 52*c*, and 52*d* becomes smaller as a result, for example, of some of the utilization units 3*a*, 3*b*. 3*c*, and 3*d* performing the heating operation (i.e., an operation in which some of the utilization-side heat exchangers 52*a*, 52*b*, 52*c*, and 52*d* function as refrigerant radiators), an operation that causes just one of the heat source-side heat exchangers 24 and 25 (e.g., the first heat source-side heat exchanger 24) to function as a refrigerant evaporator is performed.

—Concurrent Cooling and Heating Operation (Evaporation Load-Predominant)—

Figure 5:
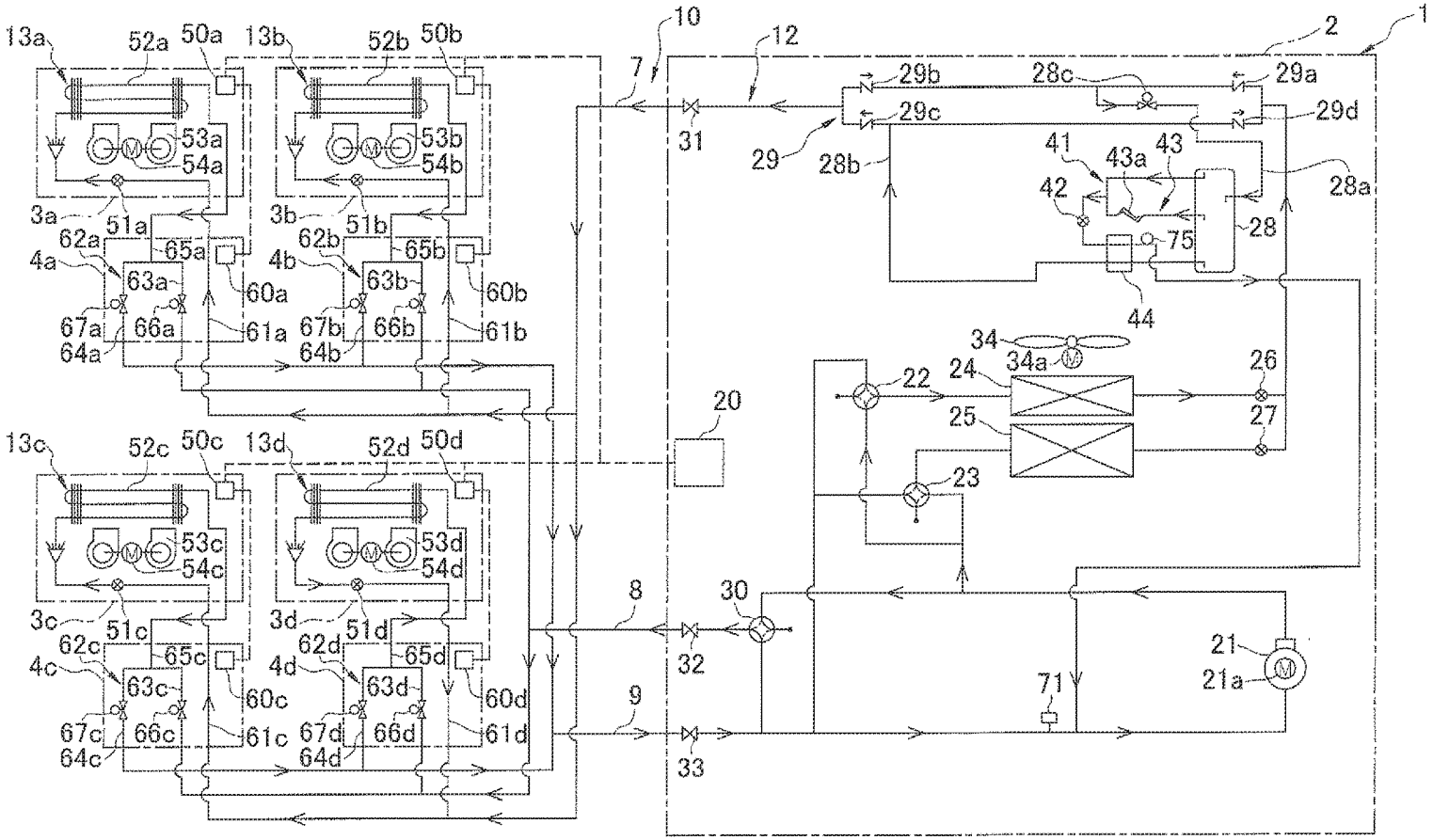
FIG. 5 is a diagram showing actions (the flow of refrigerant) in a concurrent cooling and heating operation (evaporation load-predominant).

In the concurrent cooling and heating operation (evaporation load-predominant), when, for example, the utilization units 3*a*. 3*b*, and 3*c* perform the cooling operation and the utilization unit 3*d* performs the heating operation (i.e., an operation in which the utilization-side heat exchangers 52*a*, 52*b*, and 52*c* function as refrigerant evaporators and the utilization-side heat exchanger 52*d* functions as a refrigerant radiator) and the first heat source-side heat exchanger 24 functions as a refrigerant radiator, the refrigerant circuit 10 of the air conditioning apparatus 1 is configured as shown in FIG. 5 (for the flow of the refrigerant, see the arrows added to the refrigerant circuit 10 in FIG. 5).

Specifically, in the heat source unit 2, the first heat exchange switching mechanism 22 is switched to the radiation operating state (the state indicated by the solid lines of the first heat exchange switching mechanism 22 in FIG. 5) to cause just the first heat source-side heat exchanger 24 to function as a refrigerant radiator. Furthermore, the high/low-pressure switching mechanism 30 is switched to the radiation load-predominant operating state (the state indicated by the dashed lines of the high/low-pressure switching mechanism 30 in FIG. 5). Furthermore, the first heat source-side flow rate regulating valve 26 has its opening degree regulated, the second heat source-side flow rate regulating valve 27 is closed, and the receiver inlet opening and closing valve 28*c* is opened. Moreover, the opening degree of the degassing-side flow rate regulating valve 42 serving as a degassing-side flow rate regulating mechanism is regulated, so that the gaseous refrigerant is extracted, through the receiver degassing pipe 41, from the receiver 28 to the suction side of the compressor 21. In the connection units 4*a*, 4*b*, 4*c*, and 4*d*, the high-pressure gas opening and closing valve 66*d* and the low-pressure gas opening and closing valves 67*a*, 67*b*, and 67*c* are opened and the high-pressure gas opening and closing valves 66*a*, 66*b*, and 66*c* and the low-pressure gas opening and closing valve 67*d* are closed to cause the utilization-side heat exchangers 52*a*, 52*b*, and 52*c* of the utilization units 3*a*. 3*b*, and 3*c* to function as refrigerant evaporators and cause the utilization-side heat exchanger 52*d* of the utilization unit 3*d* to function as a refrigerant radiator. Meanwhile, the utilization-side heat exchangers 52*a*, 52*b*, and 52*c* of the utilization units 3*a*, 3*b*, and 3*c* become connected to the suction side of the compressor 21 of the heat source unit 2 via the low-pressure gaseous refrigerant connecting pipe 9, and the utilization-side heat exchanger 52*d* of the utilization unit 3*d* becomes connected to the discharge side of the compressor 21 of the heat source unit 2 via the high/low-pressure gaseous refrigerant connecting pipe 8. In the utilization units 3*a*, 3*b*, 3*c*, and 3*d*, the utilization-side flow rate regulating valves 51*a*, 51*b*, 51*c*, and 51*d* have their opening degrees regulated.

In this refrigerant circuit 10, some of the high-pressure gaseous refrigerant compressed in and discharged from the compressor 21 travels through the high/low-pressure switching mechanism 30 and the high/low-pressure gas-side stop valve 32 and is delivered to the high/low-pressure gaseous refrigerant connecting pipe 8, while the rest travels through the first heat exchange switching mechanism 22 and is delivered to the first heat source-side heat exchanger 24.

Then, the high-pressure gaseous refrigerant delivered to the high/low-pressure gaseous refrigerant connecting pipe 8 is delivered to the high-pressure gas connection pipe 63*d* of the connection unit 4*d*. The high-pressure gaseous refrigerant delivered to the high-pressure gas connection pipe 63*d* travels through the high-pressure gas opening and closing valve 66*d* and the merging gas connection pipe 65*d* and is delivered to the utilization-side heat exchanger 52*d* of the utilization unit 3*d*.

Then, the high-pressure gaseous refrigerant delivered to the utilization-side heat exchanger 52*d* radiates heat as a result of exchanging heat with the room air supplied by the indoor fan 53*d* in the utilization-side heat exchanger 52*d*. Meanwhile, the room air is heated and supplied to the room, so that the heating operation of the utilization unit 3*d* is performed. The refrigerant that has radiated heat in the utilization-side heat exchanger 52*d* has its flow rate regulated in the utilization-side flow rate regulating valve 51*d* and thereafter is delivered to the liquid connection pipe 61*d* of the connection unit 4*d*.

Furthermore, the high-pressure gaseous refrigerant delivered to the first heat source-side heat exchanger 24 radiates heat as a result of exchanging heat with the outdoor air serving as a heat source supplied by the outdoor fan 34 in the first heat source-side heat exchanger 24. Then, the refrigerant that has radiated heat in the first heat source-side heat exchanger 24 has its flow rate regulated in the first heat source-side flow rate regulating valve 26, thereafter travels through the inlet check valve 29*a* and the receiver inlet opening and closing valve 28*c*, and is delivered to the receiver 28. Then, the refrigerant delivered to the receiver 28 is temporarily accumulated and separated into gaseous refrigerant and liquid refrigerant in the receiver 28, and thereafter the gaseous refrigerant is extracted through the receiver degassing pipe 41 to the suction side of the compressor 21 while the liquid refrigerant travels through the outlet check valve 29*c* and the liquid-side stop valve 31 and is delivered to the liquid refrigerant connecting pipe 7.

Then, the refrigerant that has radiated heat in the utilization-side heat exchanger 52*d* and been delivered to the liquid connection pipe 61*d* is delivered to the liquid refrigerant connecting pipe 7 and merges with the refrigerant that has radiated heat in the first heat source-side heat exchanger 24 and been delivered to the liquid refrigerant connecting pipe 7.

Then, the refrigerant that has merged together in the liquid refrigerant connecting pipe 7 is split into three flows and delivered to the liquid connection pipes 61*a*, 61*b*, and 61*c* of the connection units 4*a*, 4*b*, and 4*c*. Then, the refrigerant delivered to the liquid connection pipes 61*a*. 61*b*, and 61*c* is delivered to the utilization-side flow rate regulating valves 51*a*, 51*b*, and 51*c* of the utilization units 3*a*, 3*b*, and 3*c*.

Then, the refrigerant delivered to the utilization-side flow rate regulating valves 51*a*, 51*b*, and 51*c* has its flow rate regulated in the utilization-side flow rate regulating valves 51*a*, 51*b*, and 51*c*, and thereafter evaporates as a result of exchanging heat with the room air supplied by the indoor fans 53*a*, 53*b*, and 53*c* and becomes low-pressure gaseous refrigerant in the utilization-side heat exchangers 52*a*, 52*b*, and 52*c*. Meanwhile, the room air is cooled and supplied to the rooms, so that the cooling operation of the utilization units 3*a*, 3*b*, and 3*c* is performed. Then, the low-pressure gaseous refrigerant is delivered to the merging gas connection pipes 65*a*, 65*b*, and 65*c* of the connection units 4*a*. 4*b*, and 4*c*.

Then, the low-pressure gaseous refrigerant delivered to the merging gas connection pipes 65*a*, 65*b*, and 65*c* travels through the low-pressure gas opening and closing valves 67*a*, 67*b*, and 67*c* and the low-pressure gas connection pipes 64*a*, 64*b*, and 64*c* and is delivered to and merges together in the low-pressure gaseous refrigerant connecting pipe 9.

Then, the low-pressure gaseous refrigerant delivered to the low-pressure gaseous refrigerant connecting pipe 9 travels through the gas-side stop valve 33 and is returned to the suction side of the compressor 21.

In this way, the actions in the concurrent cooling and heating operation (evaporation load-predominant) are performed. It should be noted that in a case where the overall evaporation load of the utilization-side heat exchangers 52*a*, 52*b*. 52*c*, and 52*d* becomes smaller as a result, for example, of the number of the utilization units performing the cooling operation (i.e., the utilization-side heat exchangers functioning as refrigerant evaporators) becoming smaller, an operation that causes the second heat source-side heat exchanger 25 to function as a refrigerant evaporator to balance out the radiation load of the first heat source-side heat exchanger 24 and the evaporation load of the second heat source-side heat exchanger 25 and reduce the overall radiation load of the heat source-side heat exchangers 24 and 25 is performed.

—Concurrent Cooling and Heating Operation (Radiation Load-Predominant)—

Figure 6:
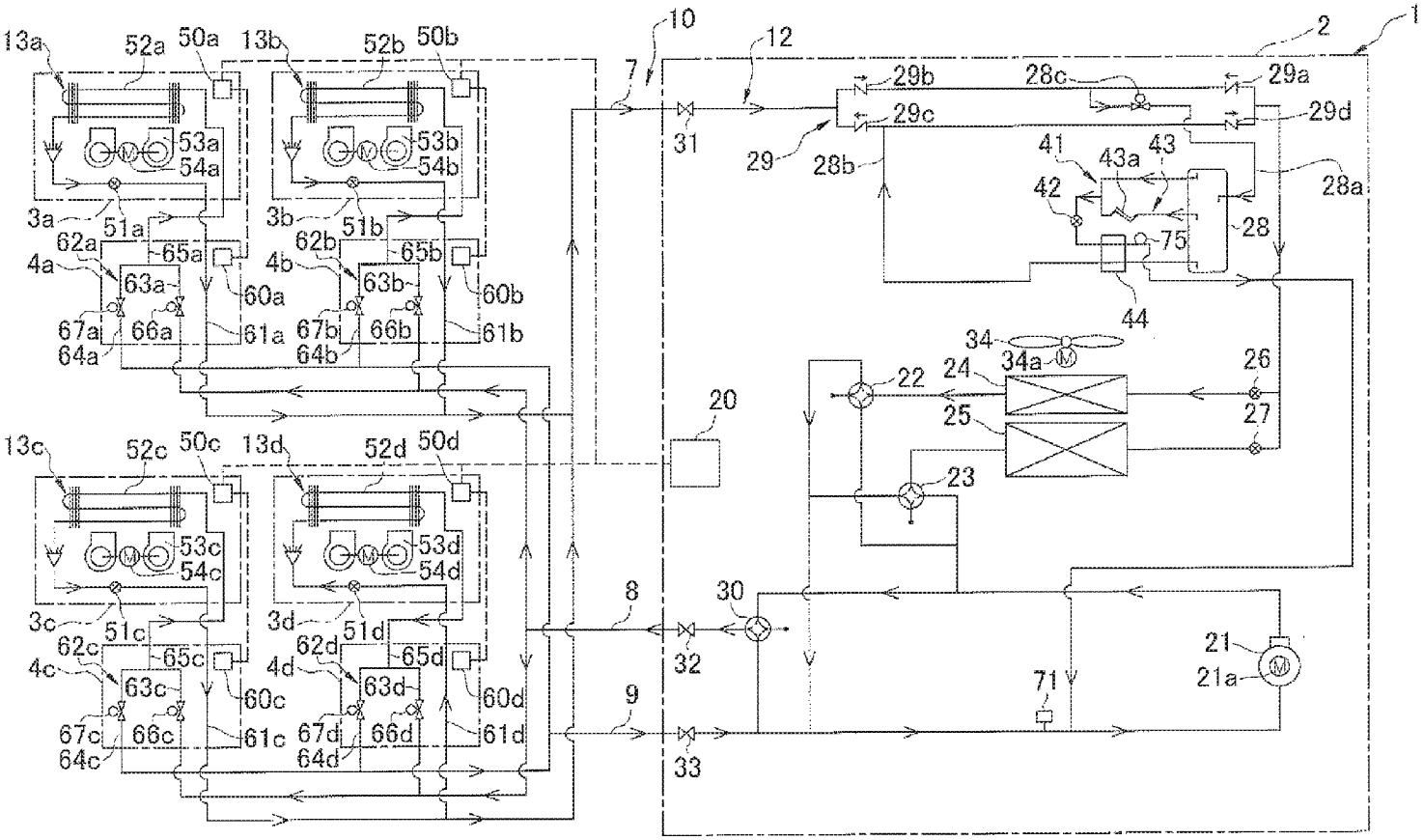
FIG. 6 is a diagram showing actions (the flow of refrigerant) in a concurrent cooling and heating operation (radiation load-predominant).

In the concurrent cooling and heating operation (radiation load-predominant), when, for example, the utilization units 3*a*, 3*b*, and 3*c* perform the heating operation and the utilization unit 3*d* performs the cooling operation (i.e., an operation in which the utilization-side heat exchangers 52*a*, 52*b*, and 52*c* function as refrigerant radiators and the utilization-side heat exchanger 52*d* functions as a refrigerant evaporator) and just the first heat source-side heat exchanger 24 functions as a refrigerant evaporator, the refrigerant circuit 10 of the air conditioning apparatus 1 is configured as shown in FIG. 6 (for the flow of the refrigerant, see the arrows added to the refrigerant circuit 10 in FIG. 6).

Specifically, in the heat source unit 2, the first heat exchange switching mechanism 22 is switched to the evaporation operating state (the state indicated by the dashed lines of the first heat exchange switching mechanism 22 in FIG. 6) to cause just the first heat source-side heat exchanger 24 to function as a refrigerant evaporator. Furthermore, the high/low-pressure switching mechanism 30 is switched to the radiation load-predominant operating state (the state indicated by the dashed lines of the high/low-pressure switching mechanism 30 in FIG. 6). Furthermore, the first heat source-side flow rate regulating valve 26 has its opening degree regulated, the second heat source-side flow rate regulating valve 27 is closed, and the receiver inlet opening and closing valve 28*c* is opened. Moreover, the opening degree of the degassing-side flow rate regulating valve 42 serving as a degassing-side flow rate regulating mechanism is regulated, so that the gaseous refrigerant is extracted, through the receiver degassing pipe 41, from the receiver 28 to the suction side of the compressor 21. In the connection units 4*a*, 4*b*, 4*c*, and 4*d*, the high-pressure gas opening and closing valves 66*a*, 66*b*, and 66*c* and the low-pressure gas opening and closing valve 67*d* are opened and the high-pressure gas opening and closing valve 66*d* and the low-pressure gas opening and closing valves 67*a*, 67*b*, and 67*c* are closed to cause the utilization-side heat exchangers 52*a*, 52*b*, and 52*c* of the utilization units 3*a*, 3*b*, and 3*c* to function as refrigerant radiators and cause the utilization-side heat exchanger 52*d* of the utilization unit 3*d* to function as a refrigerant evaporator. Meanwhile, the utilization-side heat exchanger 52*d* of the utilization unit 3*d* becomes connected to the suction side of the compressor 21 of the heat source unit 2 via the low-pressure gaseous refrigerant connecting pipe 9, and the utilization-side heat exchangers 52*a*, 52*b*, and 52*c* of the utilization units 3*a*, 3*b*, and 3*c* become connected to the discharge side of the compressor 21 of the heat source unit 2 via the high/low-pressure gaseous refrigerant connecting pipe 8. In the utilization units 3*a*, 3*b*, 3*c*, and 3*d*, the utilization-side flow rate regulating valves 51*a*, 51*b*, 51*c*, and 51*d* have their opening degrees regulated.

In this refrigerant circuit 10, the high-pressure gaseous refrigerant compressed in and discharged from the compressor 21 travels through the high/low-pressure switching mechanism 30 and the high/low-pressure gas-side stop valve 32 and is delivered to the high/low-pressure gaseous refrigerant connecting pipe 8.

Then, the high-pressure gaseous refrigerant delivered to the high/low-pressure gaseous refrigerant connecting pipe 8 is split into three flows and delivered to the high-pressure gas connection pipes 63*a*, 63*b*, and 63*c* of the connection units 4*a*, 4*b*, and 4*c*. The high-pressure gaseous refrigerant delivered to the high-pressure gas connection pipes 63*a*, 63*b*, and 63*c* travels through the high-pressure gas opening and closing valves 66*a*, 66*b*, and 66*c* and the merging gas connection pipes 65*a*, 65*b*, and 65*c* and is delivered to the utilization-side heat exchangers 52*a*, 52*b*, and 52*c* of the utilization units 3*a*, 3*b*, and 3*c*.

Then, the high-pressure gaseous refrigerant delivered to the utilization-side heat exchangers 52*a*, 52*b*, and 52*c* radiates heat as a result of exchanging heat with the room air supplied by the indoor fans 53*a*, 53*b*, and 53*c* in the utilization-side heat exchangers 52*a*, 52*b*, and 52*c* Meanwhile, the room air is heated and supplied to the rooms, so that the heating operation of the utilization units 3*a*, 3*b*, and 3*c* is performed. The refrigerant that has radiated heat in the utilization-side heat exchangers 52*a*, 52*b*, and 52*c* has its flow rate regulated in the utilization-side flow rate regulating valves 51*a*, 51*b*, and 51*c* and thereafter is delivered to the liquid connection pipes 61*a*, 61*b*, and 61*c* of the connection units 4*a*, 4*b*, and 4*c*.

Then, the refrigerant delivered to the liquid connection pipes 61*a*, 61*b*, 61*c*, and 61*d* is delivered to and merges together in the liquid refrigerant connecting pipe 7.

Some of the refrigerant merging together in the liquid refrigerant connecting pipe 7 is delivered to the liquid connection pipe 61*d* of the connection unit 4*d*, while the rest travels through the liquid-side stop valve 31, the inlet check valve 29*b*, and the receiver inlet opening and closing valve 28*c* and is delivered to the receiver 28.

Then, the refrigerant delivered to the liquid connection pipe 61*d* of the connection unit 4*d* is delivered to the utilization-side flow rate regulating valve 51*d* of the utilization unit 3*d*.

Then, the refrigerant delivered to the utilization-side flow rate regulating valve 51*d* has its flow rate regulated in the utilization-side flow rate regulating valve 51*d*, and thereafter evaporates as a result of exchanging heat with the room air supplied by the indoor fan 53*d* and becomes low-pressure gaseous refrigerant in the utilization-side heat exchanger 52*d*. Meanwhile, the room air is cooled and supplied to the room, so that the cooling operation of the utilization unit 3*d* is performed. Then, the low-pressure gaseous refrigerant is delivered to the merging gas connection pipe 65*d* of the connection unit 4*d*.

Then, the low-pressure gaseous refrigerant delivered to the merging gas connection pipe 65*d* travels through the low-pressure gas opening and closing valve 67*d* and the low-pressure gas connection pipe 64*d* and is delivered to the low-pressure gaseous refrigerant connecting pipe 9.

Then, the low-pressure gaseous refrigerant delivered to the low-pressure gaseous refrigerant connecting pipe 9 travels through the gas-side stop valve 33 and is returned to the suction side of the compressor 21.

Furthermore, the refrigerant delivered to the receiver 28 is temporarily accumulated and separated into gaseous refrigerant and liquid refrigerant in the receiver 28, and thereafter the gaseous refrigerant is extracted through the receiver degassing pipe 41 to the suction side of the compressor 21 while the liquid refrigerant travels through the outlet check valve 29*d* and is delivered to the first heat source-side flow rate regulating valve 26. Then, the refrigerant delivered to the first heat source-side flow rate regulating valve 26 has its flow rate regulated in the first heat source-side flow rate regulating valve 26, thereafter evaporates as a result of exchanging heat with the outdoor air supplied by the outdoor fan 34 and becomes low-pressure gaseous refrigerant in the first heat source-side heat exchanger 24, and is delivered to the first heat exchange switching mechanism 22. Then, the low-pressure gaseous refrigerant delivered to the first heat exchange switching mechanism 22 merges with the low-pressure gaseous refrigerant being returned through the low-pressure gaseous refrigerant connecting pipe 9 and the gas-side stop valve 33 to the suction side of the compressor 21 and is returned to the suction side of the compressor 21.

In this way, the actions in the concurrent cooling and heating operation (radiation load-predominant) are performed. It should be noted that in a case where the overall radiation load of the utilization-side heat exchangers 52*a*, 52*b*, 52*c*, and 52*d* becomes smaller as a result, for example, of the number of the utilization units performing the heating operation (i.e., the utilization-side heat exchangers functioning as refrigerant radiators) becoming smaller, an operation that causes the second heat source-side heat exchanger 25 to function as a refrigerant radiator to balance out the evaporation load of the first heat source-side heat exchanger 24 and the radiation load of the second heat source-side heat exchanger 25 and reduce the overall evaporation load of the heat source-side heat exchangers 24 and 25 is performed.

—Detection of Liquid Level in Receiver—

In the various types of refrigeration cycle operations described above, the action of extracting the refrigerant through the receiver degassing pipe 41 from the receiver 28 to the suction side of the compressor 21 is performed. The receiver degassing pipe 41 is disposed so as to extract the refrigerant from the upper portion of the receiver 28 (here, a height position B shown in FIG. 2), so ordinarily the receiver degassing pipe 41 extracts from the receiver 28 just the gaseous refrigerant resulting from the separation of the refrigerant into gaseous refrigerant and liquid refrigerant in the receiver 28.

However, when the quantity of liquid refrigerant accumulating in the receiver 28 becomes extremely large as a result, for example, of a large quantity of surplus refrigerant occurring in the refrigerant circuit 10, there are cases where the receiver 28 ends up coming close to being full of liquid (here, the height position B), and in this case there is the concern that the liquid refrigerant will return through the receiver degassing pipe 41 from the receiver 28 to the suction side of the compressor 21.

To address this, here, as described above, the receiver liquid level detection pipe 43 for detecting whether or not the liquid level in the receiver 28 has reached a predetermined position (here, a height position A on the lower side of the height position B) on the lower side of the position where the receiver degassing pipe 41 is connected (here, the height position B) is disposed in the receiver 28.

Additionally, the detection of the liquid level in the receiver 28 by the receiver liquid level detection pipe 43 is performed by the controller in the following way. First, the receiver liquid level detection pipe 43 extracts refrigerant from the predetermined height position A in the receiver 28 during the various types of refrigeration cycle operations described above. Here, the refrigerant extracted from the receiver liquid level detection pipe 43 is in a gas state in a case where the liquid level in the receiver 28 is lower than the predetermined height position A and is in a liquid state in a case where the liquid level in the receiver 28 is at the predetermined height position A or higher.

Next, the refrigerant extracted from the receiver liquid level detection pipe 43 merges with the refrigerant extracted from the receiver degassing pipe 41. Here, the refrigerant extracted from the receiver degassing pipe 41 is in a gaseous state in a case where the liquid level in the receiver 28 is lower than the height position B. For this reason, in a case where the refrigerant extracted from the receiver liquid level detection pipe 43 is in a gaseous state, the refrigerant flowing through the receiver degassing pipe 41 after the refrigerant extracted from the receiver liquid level detection pipe 43 merges with the refrigerant extracted from the receiver degassing pipe 41 is also in a gaseous state. On the other hand, in a case where the refrigerant extracted from the receiver liquid level detection pipe 43 is in a liquid state, the refrigerant flowing through the receiver degassing pipe 41 after the refrigerant extracted from the receiver liquid level detection pipe 43 merges with the refrigerant extracted from the receiver degassing pipe 41 is in a gas-liquid two-phase state in which liquid refrigerant is mixed with gaseous refrigerant. Additionally, the refrigerant flowing through the receiver degassing pipe 41 after the refrigerant extracted from the receiver liquid level detection pipe 43 merges with the refrigerant extracted from the receiver degassing pipe 41 has its pressure reduced close to the pressure of the refrigerant on the suction side of the compressor 21 by the degassing-side flow rate regulating valve 42. Because of this pressure reduction operation by the degassing-side flow rate regulating valve 42, the refrigerant flowing through the receiver degassing pipe 41 experiences a temperature drop according to the state of the refrigerant before the pressure reduction operation. That is, in a case where the refrigerant flowing through the receiver degassing pipe 41 is in a gaseous state, the temperature drop resulting from the pressure reduction operation is small, and in a case where the refrigerant flowing through the receiver degassing pipe 41 is in a gas-liquid two-phase state, the temperature drop resulting from the pressure reduction operation becomes larger. For this reason, although it is not employed here, the temperature of the refrigerant flowing through the receiver degassing pipe 41 after the pressure reduction operation has been performed by the degassing-side flow rate regulating valve 42 can be used to detect whether or not the refrigerant extracted from the liquid level detection pipe 43 is in a liquid state (whether or not the liquid level in the receiver 28 has reached the height position A).

Next, the refrigerant flowing through the receiver degassing pipe 41 after the pressure reduction operation has been performed by the degassing-side flow rate regulating valve 42 is delivered to the refrigerant heater 44, exchanges heat with the refrigerant flowing through the receiver outlet pipe 28*b*, and is heated. Because of this heating operation by the refrigerant heater 44, the refrigerant flowing through the receiver degassing pipe 41 experiences a temperature rise according to the state of the refrigerant before the heating operation. That is, in a case where the refrigerant flowing through the receiver degassing pipe 41 after the pressure reduction operation has been performed by the degassing-side flow rate regulating valve 42 is in a gaseous state, the temperature rise resulting from the heating operation is large, and in a case where it is in a gas-liquid two-phase state, the temperature rise resulting from the pressure reduction operation becomes smaller. For this reason, here, the temperature of the refrigerant flowing through the receiver degassing pipe 41 after the heating operation has been performed by the refrigerant heater 44 is detected by the degassing-side temperature sensor 75, and this detected refrigerant temperature is used to detect whether or not the refrigerant extracted from the liquid level detection pipe 43 is in a liquid state (whether or not the liquid level in the receiver 28 has reached the height position A). Specifically, the degree of superheat of the refrigerant flowing through the receiver degassing pipe 41 after the heating operation has been performed by the refrigerant heater 44 is obtained by subtracting, from the temperature of the refrigerant detected by the degassing-side temperature sensor 75, the saturation temperature of the refrigerant obtained by converting the pressure of the refrigerant detected by the suction pressure sensor 71. Then, in a case where the degree of superheat of the refrigerant is equal to or greater than a predetermined temperature difference, it is judged that the refrigerant extracted from the liquid level detection pipe 43 is in a gaseous state (the liquid level in the receiver 28 has not reached the height position A), and in a case where the degree of superheat of the refrigerant is less than the predetermined temperature difference, it is judged that the refrigerant extracted from the liquid level detection pipe 43 is in a liquid state (the liquid level in the receiver 28 has reached the height position A).

In this way, here, the liquid level in the receiver 28 can be detected using the receiver degassing pipe 41 and the receiver liquid level detection pipe 43 disposed in the receiver 28. Additionally, because of this detection of the liquid level in the receiver 28, in a case where the liquid level in the receiver 28 has not reached the height position A, degassing from the receiver degassing pipe 41 can be performed, and in a case where the liquid level in the receiver 28 has reached the height position A, an operation for lowering the liquid level in the receiver 28 can be performed by, for example, reducing the opening degree of the degassing-side flow rate regulating valve 42 before the liquid refrigerant flows out from the receiver degassing pipe 41 (before the liquid level in the receiver 28 reaches the height position B).

(3) Characteristics of Heat Recovery Type Refrigeration Apparatus (Concurrent Cooling and Heating Operation Type Air Conditioning Apparatus)

The concurrent cooling and heating operation type air conditioning apparatus 1 has the following characteristics.

<A>

Here, as described above, first, the receiver liquid level detection pipe 43 for detecting whether or not the liquid level in the receiver 28 has reached the predetermined position (the height position A) on the lower side of the position where the receiver degassing pipe 41 is connected (the height position B) is disposed in the receiver 28. For this reason, the liquid level in the receiver 28 can be detected before the liquid level in the receiver 28 reaches the height position B of the receiver degassing pipe 41 (i.e., before the receiver 28 comes close to being full of liquid).

Moreover, here, as described above, the receiver liquid level detection pipe 43 is merged with the receiver degassing pipe 41, and the liquid level in the receiver 28 is detected using the temperature of the refrigerant flowing through the receiver degassing pipe 41 after the refrigerant extracted from the receiver liquid level detection pipe 43 merges with the refrigerant extracted from the receiver degassing pipe 41. Here, because the receiver liquid level detection pipe 43 is merged with the receiver degassing pipe 41 and includes the capillary tube 43*a*, refrigerant having a small flow rate suitable for liquid level detection can be stably extracted from the receiver liquid level detection pipe 43. That is, most of the receiver degassing pipe 41 doubles as the receiver liquid level detection pipe 43 so that most of the receiver liquid level detection pipe 43 can be dispensed with. For this reason, an increase in cost resulting from disposing the receiver liquid level detection pipe 43 can be controlled compared to a case where the receiver liquid level detection pipe 43 is disposed in the receiver 28 separately from the receiver degassing pipe 41.

Because of this, here, the liquid level in the receiver 28 can be detected and an outflow of liquid refrigerant from the receiver degassing pipe 41 can be prevented while controlling as much as possible an increase in cost.

<B>

Here, as described above, the receiver degassing pipe 41 has the refrigerant heater 44 on the downstream side of the position where the receiver liquid level detection pipe 43 merges with the receiver degassing pipe 41. For this reason, the liquid level in the receiver 28 can be detected using the temperature of the refrigerant flowing through the receiver degassing pipe 41 after the refrigerant has been heated by the refrigerant heater 44. Furthermore, the refrigerant can be heated by the refrigerant heater 44 even if, for example, liquid refrigerant becomes mixed with the refrigerant extracted from the receiver degassing pipe 41 due to some unforeseen cause such as a sudden rise in the liquid level in the receiver 28. For this reason, an outflow of liquid refrigerant from the receiver degassing pipe 41 can be reliably prevented.

<C>

Here, as described above, the receiver degassing pipe 41 has the degassing-side flow rate regulating valve 42 serving as a degassing-side flow rate regulating mechanism on the downstream side of the position where the receiver liquid level detection pipe 43 merges with the receiver degassing pipe 41. For this reason, the flow rate of the refrigerant extracted from the receiver degassing pipe 41 can be stably regulated.

(4) Example Modification 1

In the above-described embodiment, as shown in FIG. 1 to FIG. 6, a heat exchanger that uses as a heating source the liquid refrigerant flowing out from the receiver 28 is employed as the refrigerant heater 44 that heats the refrigerant extracted from the receiver degassing pipe 41. Specifically, the refrigerant heater 44 is disposed on the receiver outlet pipe 28*b*, and the refrigerant extracted from the receiver degassing pipe 41 is heated by the refrigerant flowing through the receiver outlet pipe 28*b*.

However, in this case, because the refrigerant heater 44 is disposed on the receiver outlet pipe 28*b*, it is difficult to employ a heat exchanger whose pressure loss is a little large, such as a double-tube heat exchanger, for example. Furthermore, in this case, because the liquid refrigerant flowing out from the receiver 28 serves as a heating source, the temperature difference with the refrigerant extracted from the receiver degassing pipe 41 becomes smaller and the ability to heat the refrigerant extracted from the receiver degassing pipe cannot be increased much.

Figure 7:
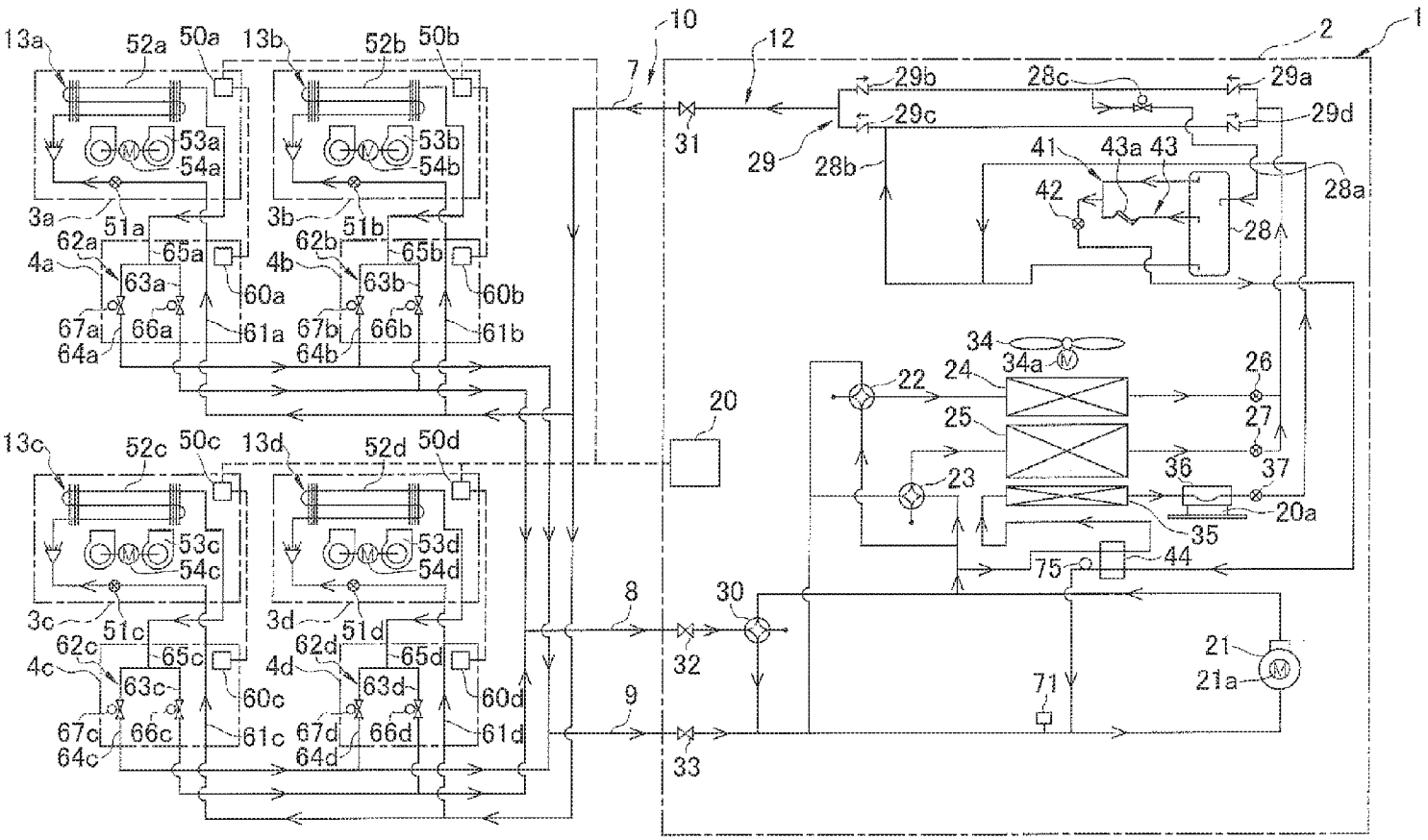
FIG. 7 is a schematic configuration diagram of a concurrent cooling and heating operation type air conditioning apparatus serving as an example modification of the refrigeration apparatus pertaining to the present invention.
Figure 8:
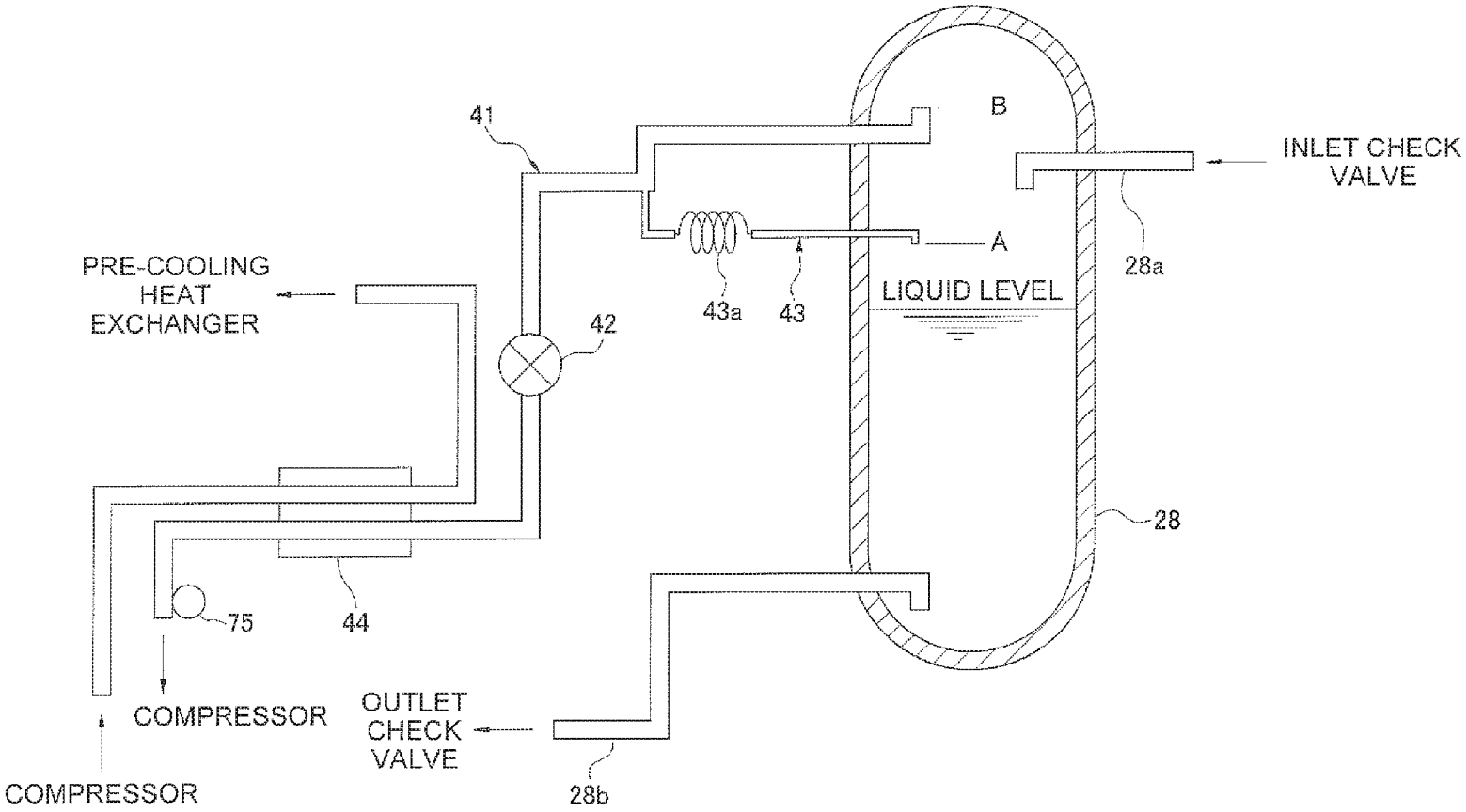
FIG. 8 is a schematic diagram showing the structure of a receiver and the area around the receiver in the concurrent cooling and heating operation type air conditioning apparatus serving as an example modification of the refrigeration apparatus pertaining to the present invention.

Therefore, here, as shown in FIG. 7 and FIG. 8, a heat exchanger that uses the high-pressure gaseous refrigerant discharged from the compressor 21 to heat the refrigerant flowing through the receiver degassing pipe 41 is employed as the refrigerant heater 44.

Specifically, here, first, the heat source-side heat exchanger that was configured by two heat exchangers comprising the first heat source-side heat exchanger 24 and the second heat source-side heat exchanger 25 in the above-described embodiment is configured by three heat exchangers comprising the heat source-side heat exchangers 24 and 25 and a pre-cooling heat exchanger 35. Additionally, the pre-cooling heat exchanger 35 that is part of the heat source-side heat exchangers 24, 25, and 35 is disposed in the refrigerant circuit 10 in such a way that it can be caused to function as a heat exchanger through which the high-pressure gaseous refrigerant discharged from the compressor 21 always flows. Here, in contrast to the heat source-side heat exchangers 24 and 25, the gas side of the pre-cooling heat exchanger 35 is connected to the discharge side of the compressor 21 without the intervention of a mechanism for enabling switching to cause the pre-cooling heat exchanger 35 to function as a refrigerant evaporator or radiator like the heat exchange switching mechanisms 22 and 23. Additionally, a refrigerant cooler 36 that cools an electrical component 20*a* including high heat-generating electrical parts such as a power element and a reactor configuring an inverter for controlling the compressor motor 21*a* is connected to the downstream side of the pre-cooling heat exchanger 35. Additionally, the refrigerant cooler 36 is caused to function as a device that cools the electrical component 20*a* by allowing heat exchange to take place between the electrical component 20*a* and the refrigerant that has radiated heat in the pre-cooling heat exchanger 36. Additionally, as for the refrigerant that has passed through the refrigerant cooler 36, the flow rate of the refrigerant flowing through the pre-cooling heat exchanger 35 and the refrigerant cooler 36 is regulated by a refrigerant cooling-side flow rate regulating valve 37 connected to the downstream side of the refrigerant cooler 36. The outlet of the refrigerant cooling-side flow rate regulating valve 37 is connected so as to merge with the receiver outlet pipe 28*b*. Here, FIG. 7 shows the flow of the refrigerant (see the arrows in FIG. 7) during the cooling operation, that is, a flow in which, during the cooling operation, some of the high-pressure gaseous refrigerant discharged from the compressor 21 is split off, travels through the pre-cooling heat exchanger 35, the refrigerant cooler 36, and the refrigerant cooling-side flow rate regulating valve 37, and merges with the receiver outlet pipe 28*b* It should be noted that, although description is omitted here, also during refrigeration cycle operations like the heating operation and the concurrent cooling and heating operation, a flow is obtained in which some of the high-pressure gaseous refrigerant discharged from the compressor 21 is split off, travels through the pre-cooling heat exchanger 35, the refrigerant cooler 36, and the refrigerant cooling-side flow rate regulating valve 37, and merges with the receiver outlet pipe 28*b*.

Additionally, here, the refrigerant heater 44 is connected to the upstream side of the pre-cooling heat exchanger 35 through which the high-pressure gaseous refrigerant discharged from the compressor 21 always flows. That is, here, during the refrigeration cycle operations, a flow is obtained in which some of the high-pressure gaseous refrigerant discharged from the compressor 21 is split off, travels through the refrigerant heater 44, the pre-cooling heat exchanger 35, the refrigerant cooler 36, and the refrigerant cooling-side flow rate regulating valve 37, and merges with the receiver outlet pipe 28*b*, and the refrigerant extracted from the receiver degassing pipe 41 becomes heated by some of the high-pressure gaseous refrigerant discharged from the compressor 21 (see FIG. 8 and the arrows in FIG. 7).

In this way, here, as described above, a heat exchanger that uses as a heating source the high-pressure gaseous refrigerant discharged from the compressor 21 is employed as the refrigerant heater 44. For this reason, the temperature difference with the refrigerant extracted from the receiver degassing pipe 41 can be increased compared to a case where, like in the above-described embodiment, a heat exchanger that uses as a heating source the liquid refrigerant flowing out from the receiver 28 is employed as the refrigerant heater 44. Because of this, here, the ability to heat the refrigerant extracted from the receiver degassing pipe 41 can be improved.

Furthermore, here, as described above, part of the heat source-side heat exchanger is configured by the pre-cooling heat exchanger 35 through which the high-pressure gaseous refrigerant discharged from the compressor 21 always flows, and the refrigerant cooler 36 that cools the electrical component 20*a* is connected to the downstream side of the pre-cooling heat exchanger 35, so the electrical component 20*a* such as a power element that controls a constituent device such as the compressor 21, for example, is cooled.

Additionally, here, utilizing this refrigerant cooling configuration, as described above, the refrigerant heater 44 that uses the high-pressure gaseous refrigerant discharged from the compressor 21 to heat the refrigerant flowing through the receiver degassing pipe 41 is connected to the upstream side of the pre-cooling heat exchanger 35. For this reason, here, the refrigerant heater 44 is disposed splitting off some of the high-pressure gaseous refrigerant discharged from the compressor 21.

Additionally, in a case where the refrigerant heater 44 is disposed splitting off some of the high-pressure gaseous refrigerant discharged from the compressor 21 in this way, it becomes easier to employ as the refrigerant heater 44 a heat exchanger whose pressure loss is a little large but whose heat exchange performance is high, such as a double-tube heat exchanger, compared to a case where, like in the above-described embodiment, a heat exchanger that uses as a heating source the liquid refrigerant flowing out from the receiver 28 is employed as the refrigerant heater 44. Because of this, here, the ability to heat the refrigerant extracted from the receiver degassing pipe 41 can be further improved.

(5) Example Modification 2

In the above-described embodiment and example modification 1, the refrigeration apparatus to which the present invention is applied is described using the configuration of the concurrent cooling and heating operation type air conditioning apparatus 1 as an example, but the present invention is not limited to this. That is, the present invention can also be applied to air conditioning apparatuses that switch between cooling and heating operations or are cooling operation-dedicated provided that the air conditioning apparatuses have a configuration that includes a compressor, a heat source-side heat exchanger, a receiver, utilization-side heat exchangers, and a receiver degassing pipe and can perform refrigeration cycle operations while extracting, through the receiver degassing pipe, gaseous refrigerant from the receiver to the suction side of the compressor.

INDUSTRIAL APPLICABILITY

The present invention is broadly applicable to refrigeration apparatuses that include a compressor, a heat source-side heat exchanger, a receiver, a utilization-side heat exchanger, and a receiver degassing pipe and can perform refrigeration cycle operations while extracting, through the receiver degassing pipe, gaseous refrigerant from the receiver to the suction side of the compressor.

What is claimed is:

1. A refrigeration apparatus comprising:

a compressor;

a heat source-side heat exchanger;

a receiver;

a utilization-side heat exchanger;

a receiver degassing pipe interconnecting an upper portion of the receiver and a suction side of the compressor, the receiver degassing pipe being arranged and configured to guide gaseous refrigerant from the receiver to the suction side of the compressor, a first open end of the receiver degassing pipe being arranged inside the receiver at a first height position;

a receiver liquid level detection pipe connected to the receiver with a second open end of the receiver liquid level detection pipe being arranged inside the receiver at a second height position lower than the first height position, another end of the receiver liquid level detection pipe-merging with the receiver degassing pipe, the receiver liquid level detection pipe including a capillary tube;

a refrigerant heater arranged on the receiver degassing pipe at a position between where the receiver liquid level detection pipe merges with the receiver degassing pipe and where the receiver degassing pipe connects to the suction side of the compressor, the refrigerant heater being provided to heat refrigerant flowing through the receiver degassing pipe;

a temperature sensor arranged and configured to detect a temperature of refrigerant flowing through the receiver degassing pipe at a position between the refrigerant heater and the suction side of the compressor; and a controller programmed to detect whether or not a liquid level in the receiver has reached the second height position using the temperature detected by the temperature sensor.

2. The refrigeration apparatus according to claim 1, wherein the refrigerant heater is a heat exchanger that uses high-pressure gaseous refrigerant discharged from the compressor to heat refrigerant flowing through the receiver degassing pipe.

3. The refrigeration apparatus according to claim 2, wherein part of the heat source-side heat exchanger is a pre-cooling heat exchanger through which the high-pressure gaseous refrigerant discharged from the compressor always flows, a refrigerant cooler that cools an electrical component is connected to a downstream side of the pre-cooling heat exchanger with respect to a flow direction of the high-pressure gaseous refrigerant, and the refrigerant heater is connected to an upstream side of the pre-cooling heat exchanger with respect to the flow direction of the high-pressure gaseous refrigerant.

4. The refrigeration apparatus according to claim 1, wherein a degassing-side flow rate regulating mechanism arranged and configured to regulate a flow rate of refrigerant flowing through the receiver degassing pipe, the degassing-side flow rate regulating mechanism being arranged in the receiver degassing pipe at a position between where the receiver liquid level detection pipe merges with the receiver degassing pipe and where the receiver degassing pipe connects to the suction side of the compressor.

5. The refrigeration apparatus according to claim 2, wherein a degassing-side flow rate regulating mechanism arranged and configured to regulate a flow rate of refrigerant flowing through the receiver degassing pipe, the degassing-side flow rate regulating mechanism being arranged in the receiver degassing pipe at a position between where the receiver liquid level detection pipe merges with the receiver degassing pipe and where the receiver degassing pipe connects to the suction side of the compressor.

* * * * *